US006312111B1

(12) United States Patent
Kimura et al.

(10) Patent No.: US 6,312,111 B1
(45) **Date of Patent: *Nov. 6, 2001**

(54) LIQUID EJECTING HEAD, LIQUID EJECTING DEVICE AND LIQUID EJECTING METHOD

(75) Inventors: Makiko Kimura, Sagamihara; Hiroshi Sugitani, Machida; Masami Ikeda, Yokohama; Toshio Kashino, Chigasaki; Takeshi Okazaki, Sagamihara; Aya Yoshihira; Kiyomitsu Kudo, both of Yokohama; Yoshie Nakata, Kawasaki, all of (JP)

(73) Assignee: Canon Kabushiki Kaisha, Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/586,261

(22) Filed: Jan. 16, 1996

(30) Foreign Application Priority Data

Jan. 13, 1995 (JP) ..... 7-004109
Jun. 27, 1995 (JP) ..... 7-160911

(51) Int. Cl.[7] ..... B41J 2/05
(52) U.S. Cl. ..... 347/65
(58) Field of Search ..... 347/65, 63, 56, 347/55, 54, 70, 1

(56) References Cited

U.S. PATENT DOCUMENTS

| | | | |
|---|---|---|---|
| 4,412,224 | 10/1983 | Sugitani | 347/65 |
| 4,417,251 | 11/1983 | Sugitani | 347/65 |
| 4,437,100 | 3/1984 | Sugitani et al. | 347/65 |
| 4,450,455 | 5/1984 | Sugitani et al. | 347/45 |
| 4,480,259 | 10/1984 | Kruger et al. | 347/63 |
| 4,487,662 | 12/1984 | Fischbeck | 204/15 |
| 4,496,960 | 1/1985 | Fischbeck | 347/65 |
| 4,509,063 | 4/1985 | Sugitani et al. | 347/65 |
| 4,521,787 | 6/1985 | Yokota et al. | 347/65 |
| 4,558,333 | 12/1985 | Sugitani et al. | 347/65 |
| 4,568,953 | 2/1986 | Aoki et al. | 347/65 |
| 4,609,427 | 9/1986 | Inamoto et al. | 216/27 |

(List continued on next page.)

FOREIGN PATENT DOCUMENTS

| | | | |
|---|---|---|---|
| 3328597 | 3/1984 | (DE) . | |
| 0 436 047 | 7/1991 | (EP) | B41J/2/055 |
| 0436047 | 7/1991 | (EP) . | |
| 55-81172 | 6/1980 | (JP) . | |
| 61-69467 | 4/1986 | (JP) . | |
| 61-110557 | 5/1986 | (JP) . | |
| 62-156969 | 7/1987 | (JP) . | |
| 62-222854 | 9/1987 | (JP) . | |
| 63-028654 | 2/1988 | (JP) . | |
| 63-197652 | 8/1988 | (JP) . | |
| 63-199972 | 8/1988 | (JP) . | |
| 3-81155 | 4/1991 | (JP) . | |
| 04-118248 | 4/1992 | (JP) . | |
| 5-124189 | 5/1993 | (JP) . | |
| 6-87214 | 3/1994 | (JP) . | |

*Primary Examiner*—John Barlow
*Assistant Examiner*—Craig A. Hallacher
(74) *Attorney, Agent, or Firm*—Fitzpatrick, Cella, Harper & Scinto

(57) ABSTRACT

A liquid ejecting method for ejecting liquid by generation of a bubble includes preparing a head comprising an ejection outlet for ejecting the liquid, a bubble generation region for generating the bubble in the liquid, a movable member having a fulcrum and a free end portion; and displacing the free end of the movable member by pressure produced by the generation of the bubble in the bubble generating portion wherein the free end of the movable member is restrained from entering the bubble generation region beyond a first position which is taken by the free end of the movable member before generation of the bubble.

58 Claims, 23 Drawing Sheets

U.S. PATENT DOCUMENTS

| | | | |
|---|---|---|---|
| 4,611,219 | 9/1986 | Sugitani et al. | 347/40 |
| 4,646,110 | 2/1987 | Ikeda et al. | 347/15 |
| 4,666,823 | 5/1987 | Yokota et al. | 430/320 |
| 4,723,129 | 2/1988 | Endo et al. | 347/56 |
| 4,994,825 | 2/1991 | Saito et al. | 347/63 |
| 5,095,321 | 3/1992 | Saito et al. | 347/63 |
| 5,148,192 * | 9/1992 | Izumida et al. | 347/44 |
| 5,208,604 | 5/1993 | Watanabe et al. | 347/47 |
| 5,262,802 | 11/1993 | Karita et al. | 347/87 |
| 5,278,585 | 1/1994 | Karz et al. | 347/65 |
| 5,389,957 | 2/1995 | Kimura et al. | 347/20 |
| 5,485,184 | 1/1996 | Nakagomi et al. | 347/63 |

* cited by examiner

FIG. 11(a)
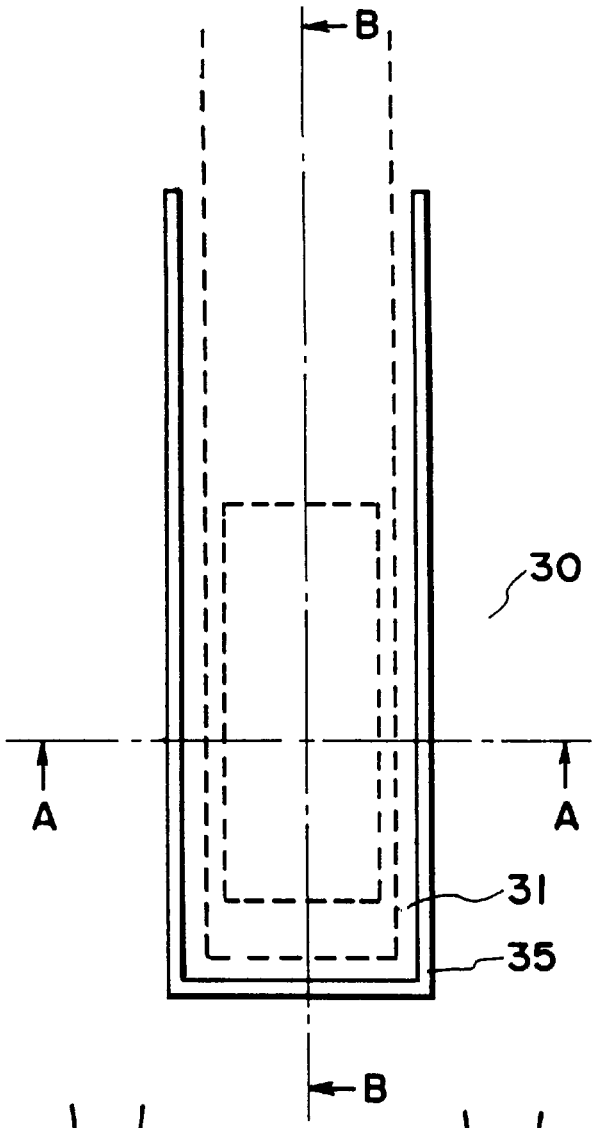
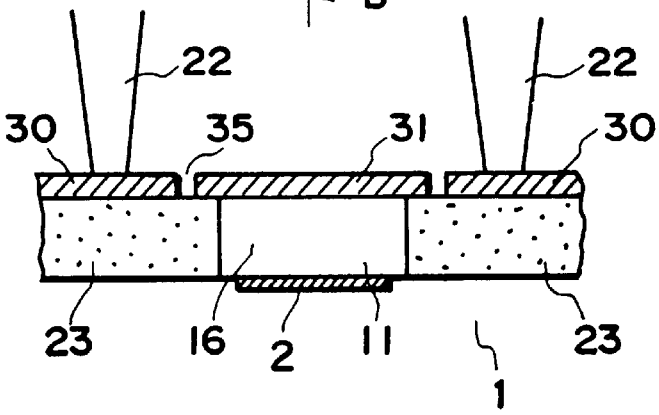
FIG. 11(b)

LIQUID EJECTING HEAD, LIQUID EJECTING DEVICE AND LIQUID EJECTING METHOD

FIELD OF THE INVENTION AND RELATED ART

The present invention relates to a liquid ejecting head for ejecting desired liquid using generation of a bubble by applying thermal energy to the liquid, a head cartridge using the liquid ejecting head, a liquid ejecting device using the same, a manufacturing method for the liquid ejecting head, a liquid ejecting method, a recording method, and a print provided using the liquid ejecting method. It further relates to an ink jet head kit containing the liquid ejection head.

More particularly, it relates to a liquid ejecting head having a movable member movable by generation of a bubble, and a head cartridge using the liquid ejecting head, and liquid ejecting device using the same. It further relates to a liquid ejecting method and recording method for ejection the liquid by moving the movable member using the generation of the bubble.

The present invention is applicable to equipment such as a printer, a copying machine, a facsimile machine having a communication system, a word processor having a printer portion or the like, and an industrial recording device combined with various processing device or processing devices, in which the recording is effected on a recording material such as paper, thread, fiber, textile, leather, metal, plastic resin material, glass, wood, ceramic and so on.

In this specification, "recording" means not only forming an image of letter, figure or the like having specific meanings, but also includes forming an image of a pattern not having a specific meaning.

An ink jet recording method of so-called bubble jet type is known in which an instantaneous state change resulting in an instantaneous volume change (bubble generation) is caused by application of energy such as heat to the ink, so as to eject the ink through the ejection outlet by the force resulted from the state change by which the ink is ejected to and deposited on the recording material to form an image formation. As disclosed in U.S. Pat. No. 4,723,129, a recording device using the bubble jet recording method comprises an ejection outlet for ejecting the ink, an ink flow path in fluid communication with the ejection outlet, and an electrothermal transducer as energy generating means disposed in the ink flow path.

With such a recording method is advantageous in that, a high quality image, can be recorded at high speed and with low noise, and a plurality of such ejection outlets can be posited at high density, and therefore, small size recording apparatus capable of providing a high resolution can be provided, and color images can be easily formed. Therefore, the bubble jet recording method is now widely used in printers, copying machines, facsimile machines or another office equipment, and for industrial systems such as textile printing device or the like.

With the increase of the wide needs for the bubble jet technique, various demands are imposed thereon, recently.

For example, an improvement in energy use efficiency is demanded. To meet the demand, the optimization of the heat generating element such as adjustment of the thickness of the protecting film is investigated. This method is effective in that a propagation efficiency of the generated heat to the liquid is improved.

In order to provide high image quality images, driving conditions have been proposed by which the ink ejection speed is increased, and/or the bubble generation is stabilized to accomplish better ink ejection. As another example, from the standpoint of increasing the recording speed, flow passage configuration improvements have been proposed by which the speed of liquid filling (refilling) into the liquid flow path is increased.

Japanese Laid Open Patent Application No. SHO-63-199972 propose flow passage structures as disclosed in FIG. 1(*a*) and (*b*), for example.

The liquid path or passage structure of a manufacturing method therefor are proposed from the standpoint of the back wave toward the liquid chamber. This back wave is considered as energy loss since it does not contribute to the liquid ejection. It proposes a valve 10 disposed upstream of the heat generating element 2 with respect to the direction of general flow of the liquid, and is mounted on the ceiling of the passage. It takes an initial position wherein it extends along the ceiling. Upon bubble generation, it takes the position wherein it extends downwardly, thus suppressing a part of the back wave by the valve 10. When th valve is generated in the path 3, the suppression of the back wave is not practically significant. The back wave is not directly contributable to the ejection of the liquid. Upon the back wave occurs in the path, the pressure for directly ejecting the liquid already makes the liquid ejectable from the passage.

On the other hand, in the bubble jet recording method, the heating is repeated with the heat generating element contacted with the ink, and therefore, a burnt material is deposited on the surface of the heat generating element due to kogation of the ink. However, the amount of the deposition may be large depending on the materials of the ink. if this occurs, the ink ejection becomes unstable. Additionally, even when the liquid to be ejected is the one easily deteriorated by heat or even when the liquid is the one with which the bubble generation is not sufficient, the liquid is desired to be ejected in good order without property change.

Japanese Laid Open Patent Application No. SHO-61-69467, Japanese Laid Open Patent Application No. SHO-55-81172 and U.S. Pat. No. 4,480,259 disclose that different liquids are used for the liquid generating the bubble by the heat (bubble generating liquid) and for the liquid to be ejected (ejection liquid). In these publications, the ink as the ejection liquid and the bubble generation liquid are completely separated by a flexible film of silicone rubber or the like so as to prevent direct contact of the ejection liquid to the heat generating element while propagating the pressure resulting from the bubble generation of the bubble generation liquid to the ejection liquid by the deformation of the flexible film. The prevention of the deposition of the material on the surface of the heat generating element and the increase of the selection latitude of the ejection liquid are accomplished, by such a structure.

However, with this structure in which the ejection liquid and the bubble generation liquid are completely separated, the pressure by the bubble generation is propagated to the ejection liquid through the expansion-contraction deformation of the flexible film, and therefore, the pressure is absorbed by the flexible film to a quite high degree. In addition, the deformation of the flexible film is not so large, and therefore, the energy use efficiency and the ejection force are deteriorated although the some effect is provided by the provision between the ejection liquid and the bubble generation liquid.

SUMMARY OF THE INVENTION

Accordingly, it is a principal object of the present invention to provide a structure for a movable member in a liquid ejection using the movable member.

It is another object of the present invention to procide a liquid ejection principle with which the generated bubble is controlled in a novel manner.

It is a further object of the present invention to provide a liquid ejecting method, liquid ejecting head and so on wherein heat accumulation in the liquid on the heat generating element is significantly reduced, and the residual bubble on the heat generating element is reduced, while improving the ejection efficiency and the ejection pressure.

It is a further object of the present invention to provide a liquid ejecting head and so on wherein inertia force in a direction against liquid supply direction due to back wave is suppressed, and simultaneously, a degree of retraction of a meniscus is reduction by a valve function of a movable member by which the refilling frequency is increased, thus permitting high speed printing.

It is a further object of the present invention to provide a liquid ejecting head and so on wherein deposition of residual material on the heat generating element is reduced, and the range of the usable liquid is widened, and in addition, the ejection efficiency and the ejection force are significantly increased.

It is a further object of the present invention to provide a liquid ejection method and a liquid ejection head, wherein excessive vibration is regurated within a desired range, and the durability of the movable member is improved.

It is a further object of the present invention to provide a liquid ejecting method, a liquid ejecting head and so on, wherein the choice of the liquid to be ejected is made greater.

It is a further object of the present invention to provide a head kit for permitting easy refuse of the liquid ejecting head.

According to an aspect of the present invention, there is provided a liquid ejecting method for ejecting liquid by generation of a bubble, comprising: preparing a head comprising an ejection outlet for ejecting the liquid, a bubble generation region for generating the bubble in the liquid, a movable member having a fulcrum and a free end portion; and displacing the free end of said movable member by pressure produced by the generation of the bubble in said bubble generating portion, wherein the free end of said movable member is restrained from entering the bubble generation region beyond a first position which is taken by the free end of said movable member before generation of the bubble.

According to another aspect of the present invention, there is provided a liquid ejecting method for ejecting a liquid droplet through an ejection outlet disposed at a position not faced to a bubble generation region and downstream of the bubble generation region with respect to a liquid droplet ejection direction, by generation of bubble in the bubble generation region, wherein providing a movable member having a free end portion for substantially sealing an ejection outlet side region of said bubble generation region relative to said ejection outlet and a surface portion extending from the free end portion to a fulcrum portion which is disposed away from the free end in a direction away from said ejection outlet; moving said free end from it substantial sealing position by generation of the bubble to open said bubble generation region to the ejection outlet to eject the liquid droplet; wherein the free end of said movable member is restrained from entering the bubble generation region beyond a first position which is taken by the free end of said movable member before generation of the bubble.

According to a further aspect of the present invention, there is provided a liquid ejection recording method wherein recording liquid is ejection by generation of a bubble to effect recording, comprising: supplying the recording liquid along a heat generating element disposed along a flow path from upstream of the heat generating element; and applying heat generated by the heat generating element to the thus supplied liquid to generate a bubble, thus moving a free end of a movable member having the free end adjacent the ejection outlet side by pressure produced by the generation of the bubble, to eject the liquid to the recording material, said movable member being disposed faced to said heat generating element, wherein the free end of said movable member is restrained from entering the bubble generation region beyond a first position which is taken by the free end of said movable member before generation of the bubble.

According to a further aspect of the present invention, there is provided a liquid ejecting method for ejecting liquid by generation of a bubble, comprising: preparing a head including a first liquid flow path in fluid communication with a liquid ejection outlet, a second liquid flow path having a bubble generation region and a movable member disposed between said first liquid flow path and said bubble generation region and having a free end adjacent the ejection outlet side; and generating a bubble in said bubble generation region to displace the free end of the movable member into said first liquid flow path by pressure produced by the generation of the bubble, thus guiding the pressure toward the ejection outlet of said first liquid flow path by the movement of the movable member to eject the liquid; wherein the free end of said movable member is restrained from entering the bubble generation region beyond a first position which is taken by the free end of said movable member before generation of the bubble.

According to a further aspect of the present invention, there is provided a liquid ejecting head for ejecting liquid by generation of bubble, comprising: an ejection outlet for ejecting the liquid; a bubble generation region for generating the bubble in the liquid; a movable member having a fulcrum and a free end; wherein the free end of said movable member moves from by pressure produced by the generation of the bubble; and restraining means for restraining the free end of said from entering the bubble generation region beyond a first position which is taken by the free end of said movable member before generation of the bubble.

According to a further aspect of the present invention, there is provided a liquid ejecting head for ejecting liquid by generation of bubble, comprising: a first liquid flow path in fluid communication with an ejection outlet; a second liquid flow path having bubble generation region for generating the bubble in the liquid by applying heat to the liquid; a movable member disposed between said first liquid flow path and said bubble generation region and having a free end portion adjacent the ejection outlet, wherein the free end of the movable member is displaced into said first liquid flow path by pressure produced by the generation of the bubble, thus guiding the pressure toward the ejection outlet of said first liquid flow path by the movement of the movable member to eject the liquid; and restraining means for restraining the free end of said from entering the bubble generation region beyond a first position which is taken by the free end of said movable member before generation of the bubble.

According to a further aspect of the present invention, there is provided a liquid ejection recording method for ejecting recording liquid by generation of a bubble to effect recording, comprising: preparing a head comprising an ejection outlet for ejecting the recording liquid, a bubble generation region for generating the bubble in the liquid, a movable member having a fulcrum and a free end; and displacing the free end of said movable member by pressure produced by the generation of the bubble in said bubble generating portion, wherein the free end of said movable member is restrained from entering the bubble generation region beyond a first position which is taken by the free end of said movable member before generation of the bubble.

According to a further aspect of the present invention there is provided a head cartridge comprising: a liquid ejecting head as defined above; and a liquid container for containing the liquid to be supplied to the liquid ejecting head.

According to a further aspect of the present invention there is provided a liquid ejecting apparatus for ejecting recording liquid by generation of a bubble, comprising: a liquid ejecting head as defined above; and driving signal supply means for supplying a driving signal for ejecting the liquid through the liquid ejecting head.

According to a further aspect of the present invention there is provided a liquid ejecting apparatus for ejecting recording liquid by generation of a bubble, comprising: a liquid ejecting head as defined above; and recording material transporting means for feeding a recording material for receiving the liquid ejected from the liquid ejecting head.

According to a further aspect of the present invention there is provided a recording system comprising: a liquid ejecting apparatus as defined above; and a pre-processing or post-processing means for promoting fixing of the liquid on the recording material after the recording.

According to a further aspect of the present invention there is provided a head kit comprising: a liquid ejecting head as defined above; and a liquid container containing the liquid to be supplied to the liquid ejecting head.

According to a further aspect of the present invention there is provided a head kit comprising: a liquid ejecting head as defined above; a liquid container for containing the liquid to be supplied to the liquid ejecting head; and liquid filling means for filling the liquid into the liquid container.

According to a further aspect of the present invention there is provided a recorded material characterized by being recorded by ejected ink through a liquid ejection recording method as defined above.

According to the present invention, the object of which is to provide the structure described above, it was possible to prevent the free end of the moving member from moving into the bubble generation region (toward the heat generating member) far beyond the first position; therefore, the durability of the moving member could be improved.

With the liquid ejecting method and the head using the novel ejection principle, a synergistic effect is provided by the generated bubble and the movable member moved thereby so that the liquid adjacent the ejection outlet can be ejection with high efficiency, and therefore, the ejection efficiency is improved. For example, in the most desirable type of the present invention, the ejection efficiency is increased even to twice the conventional one.

In another aspect of the present invention, even if the printing operation is started after the recording head is left in a low temperature or low humidity condition for a long term, the ejection failure can be avoided. even if the ejection failure occurs, the normal operation is recovered by a small scale recovery process including a preliminary ejection and sucking recovery.

In an aspect of improving the refilling property, the responsivity, the stabilized growth of the bubble and stabilization of the liquid droplet during the continuous ejections are accomplished, thus permitting high speed recording.

In this specification, "upstream" and "downstream" are defined with respect to a general liquid flow from a liquid supply source to the ejection outlet through the bubble generation region (movable member).

As regards the bubble per se, the "downstream" is defined as toward the ejection outlet side of the bubble which directly function to eject the liquid droplet. More particularly, it generally means a downstream from the center of the bubble with respect to the direction of the general liquid flow, or a downstream from the center of the area of the heat generating element with respect to the same.

In this specification, "substantially sealed" generally means a sealed state in such a degree that when the bubble grows, the bubble does not escape through a gap (slit) around the movable member before motion of the movable member.

In this specification, "separation wall" may mean a wall (which may include the movable member) interposed to separate the region in direct fluid communication with the ejection outlet from the bubble generation region, and more specifically means a wall separating the flow path including the bubble generation region from the liquid flow path in direct fluid communication with the ejection outlet, thus preventing mixture of the liquids in the liquid flow paths.

These and other objects, features and advantages of the present invention will become more apparent upon a consideration of the following description of the preferred embodiments of the present invention taken in conjunction with the accompanying drawings.

BRIEF DESCRIPTION OF THE DRAWINGS

FIGS. 11(*a*) and 11(*b*) depict the essential portion of the liquid ejection head in the fourth embodiment of the present invention.

DESCRIPTION OF THE PREFERRED EMBODIMENT

Embodiment 1

Referring to the accompanying drawings, the embodiments of the present invention will be described.

Figure 1A:
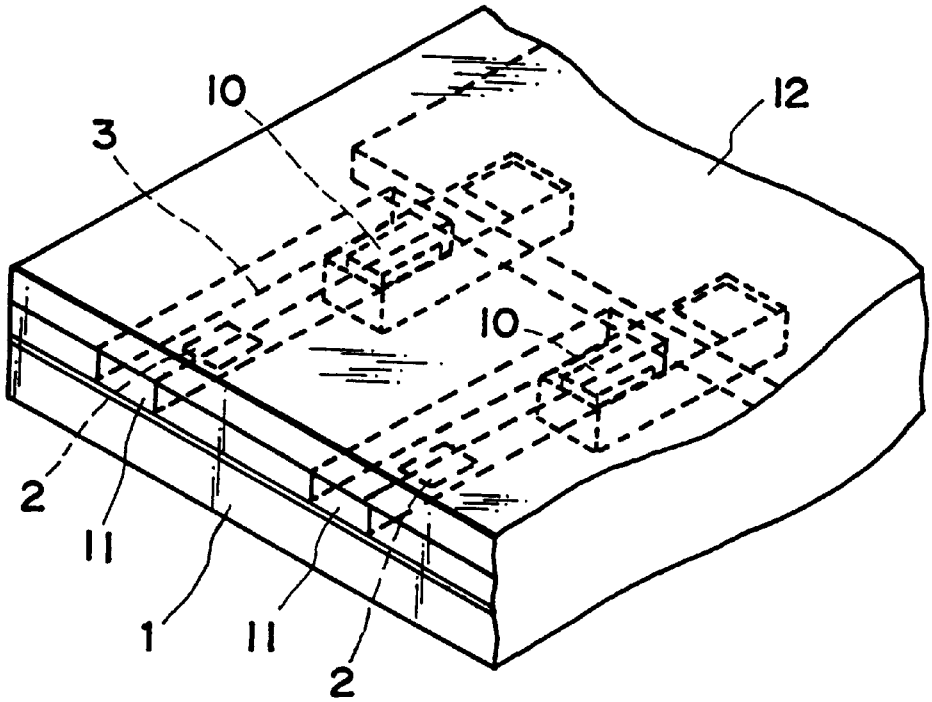
FIG. 1(a) PRIOR ART
FIGS. 1(*a*) and 1(*b*) are sectional views of a liquid flow path of a conventional liquid ejecting head.
Figure 1B:
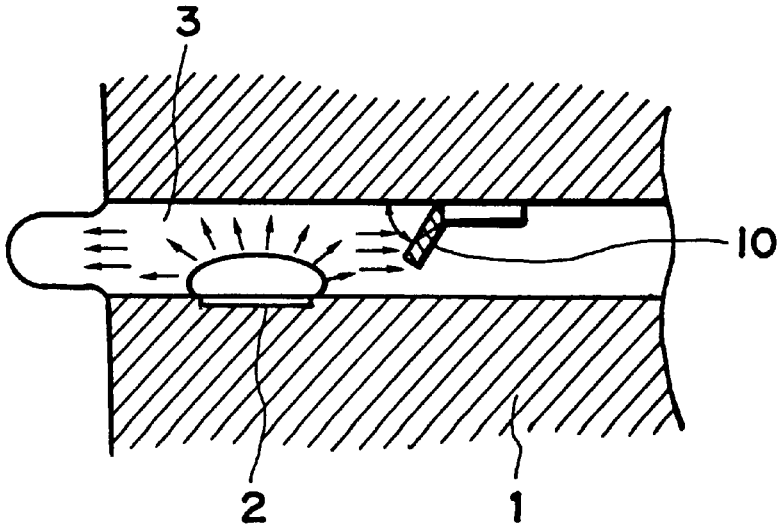
FIG. 1(b) PRIOR ART
Figure 2A:
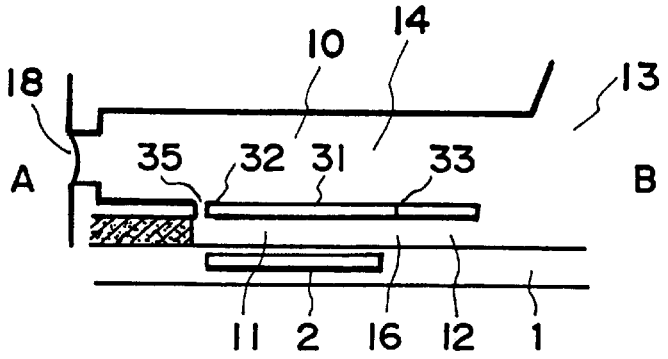
FIG. 2 (*a–d*) are schematic sectional views of an example of a liquid ejecting head of an embodiment of the present invention.
Figure 2B:
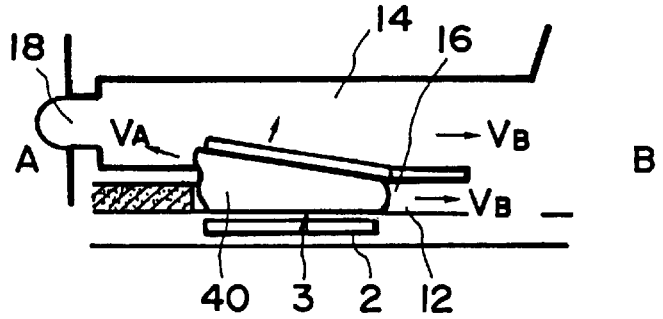
Figure 2C:
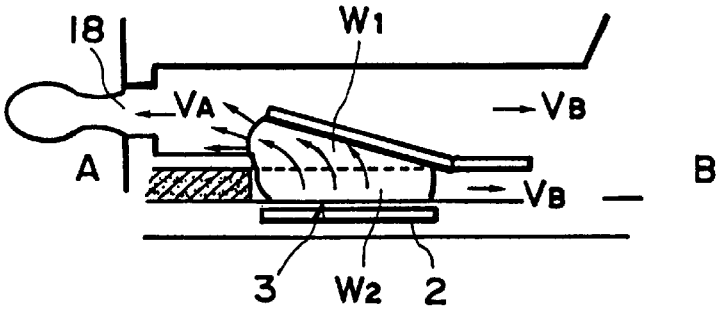
Figure 2D:
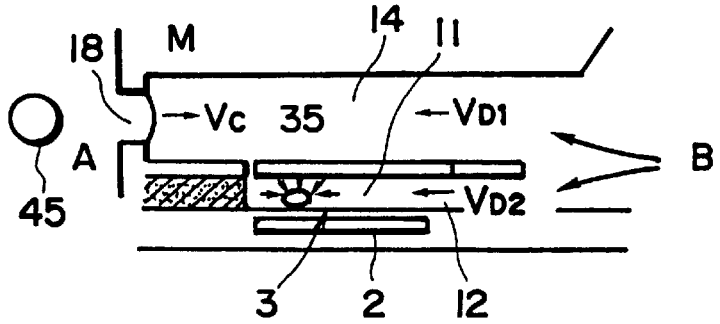
Figure 3:
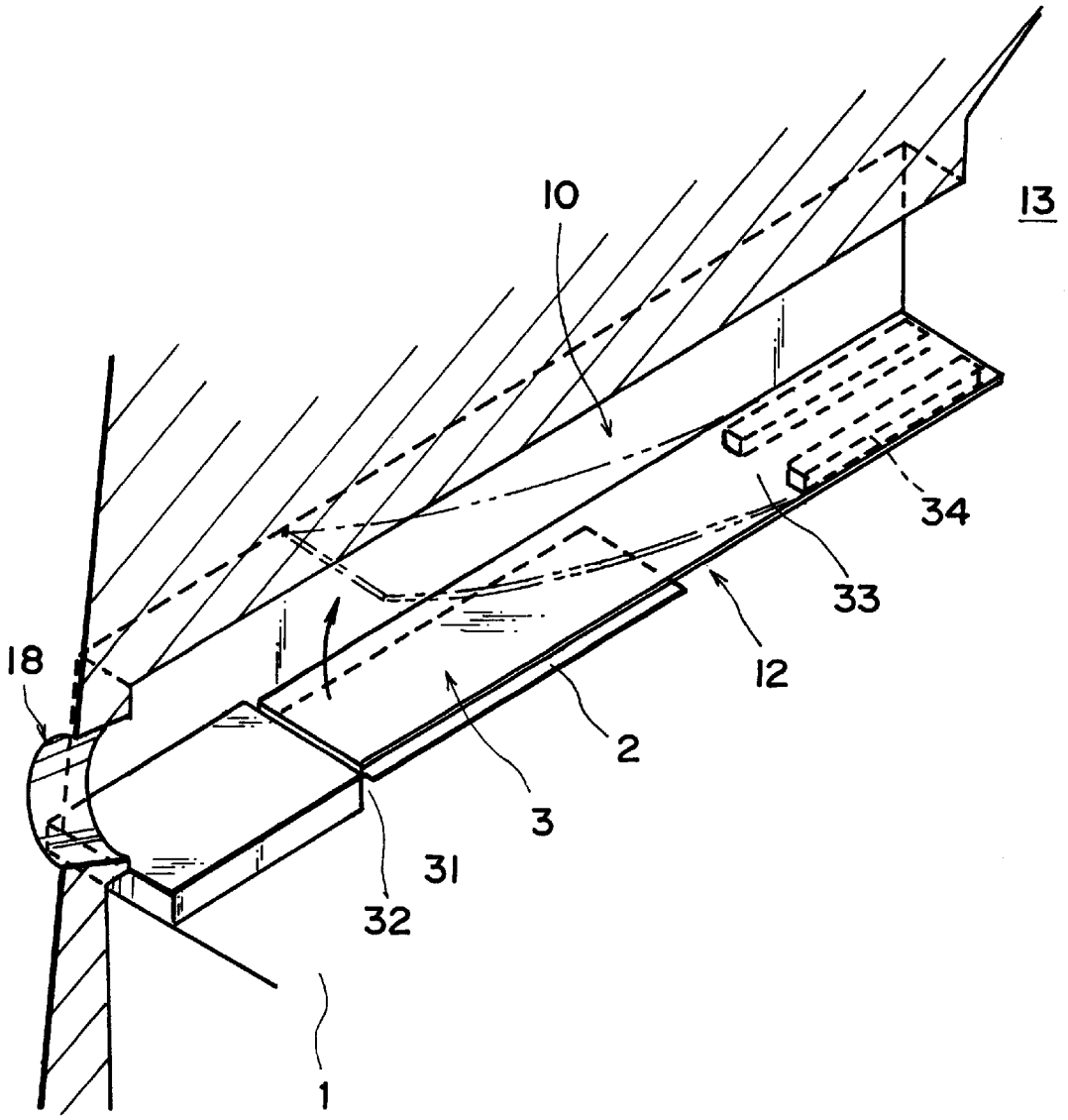
FIG. 3 is a partly broken perspective view of a liquid ejecting head according to an embodiment of the present invention.

In this embodiment, the description will be made as to an improvement in an ejection force and/or an ejection efficiency by controlling a direction of propagation of pressure resulting from generation of a bubble for ejecting the liquid and controlling a direction of growth of the bubble, usable with this embodiment. FIG. 2 is a schematic sectional view of a liquid ejecting head taken along a liquid flow path usable with this embodiment, and FIG. 3 is a partly broken perspective view of the liquid ejecting head.

The liquid ejecting head of this embodiment comprises a heat generating element 2 (a heat generating resistor of 40 μm×105 μm in this embodiment) as the ejection energy generating element for supplying thermal energy to the liquid to eject the liquid, an element substrate 1 on which said heat generating element 2 is provided, and a liquid flow path 10 formed above the element substrate correspondingly to the heat generating element 2. The liquid flow path 10 is in fluid communication with a common liquid chamber 13 for supplying the liquid to a plurality of such liquid flow paths 10 which is in fluid communication with a plurality of the ejection outlets 18.

Above the element substrate in the liquid flow path 10, a movable member or plate 31 in the form of a cantilever of an elastic material such as metal is provided faced to the heat generating element 2. One end of the movable member is fixed to a foundation (supporting member) 34 or the like provided by patterning of photosensitivity resin material on the wall of the liquid flow path 10 or the element substrate. By this structure, the movable member is supported, and a fulcrum (fulcrum portion) is constituted.

The movable member 31 is so positioned that it has a fulcrum (fulcrum portion which is a fixed end) 33 in an upstream side with respect to a general flow of the liquid from the common liquid chamber 13 toward the ejection outlet 18 through the movable member 31 caused by the ejecting operation and that it has a free end (free end portion) 32 in a downstream side of the fulcrum 33. the movable member 31 is faced to the heat generating element 2 with a gap of 15 μm approx. as if it covers the heat generating element 2. A bubble generation region is constituted between the heat generating element and movable member. The type, configuration or position of the heat generating element or the movable member is not limited to the ones described above, but may be changed as long as the growth of the bubble and the propagation of the pressure can be controlled. For the purpose of easy understanding of the flow of the liquid which will be described hereinafter, the liquid flow path 10 is divided by the movable member 31 into a first liquid flow path 14 which is directly in communication with the ejection outlet 18 and a second liquid flow path 16 having the bubble generation region 11 and the liquid supply port 12.

By causing heat generation of the heat generating element 2, the heat is applied to the liquid in the bubble generation region 11 between the movable member 31 and the heat generating element 2, by which a bubble is generated by the film boiling phenomenon as disclosed in U.S. Pat. No. 4,723,129. The bubble and the pressure caused by the generation of the bubble act mainly on the movable member, so that the movable member 31 moves or displaces to widely open toward the ejection outlet side about the fulcrum 33, as shown in FIG. 2 (*b*) and (*c*) or in FIG. 3. By the displacement of the movable member 31 or the state after the displacement, the propagation of the pressure caused by the generation of the bubble and the growth of the bubble per se are directed toward the ejection outlet.

Here, one of the fundamental ejection principles used with the present invention will be described. One of important principles of this invention is that the movable member disposed faced to the bubble is displaced from the normal first position to the displaced second position on the basis of the pressure of the bubble generation or the bubble per se, and the displacing or displaced movable member 31 is effective to direct the pressure produced by the generation of the bubble and/or the growth of the bubble per se toward the ejection outlet 18 (downstream side).

Figure 4:
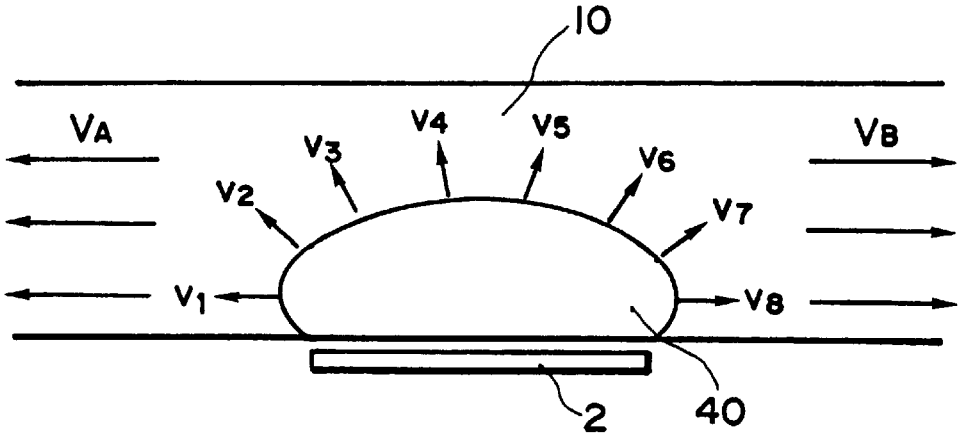
FIG. 4 PRIOR ART
FIG. 4 is a schematic view of pressure propagation from a bubble in a conventional head.
Figure 5:
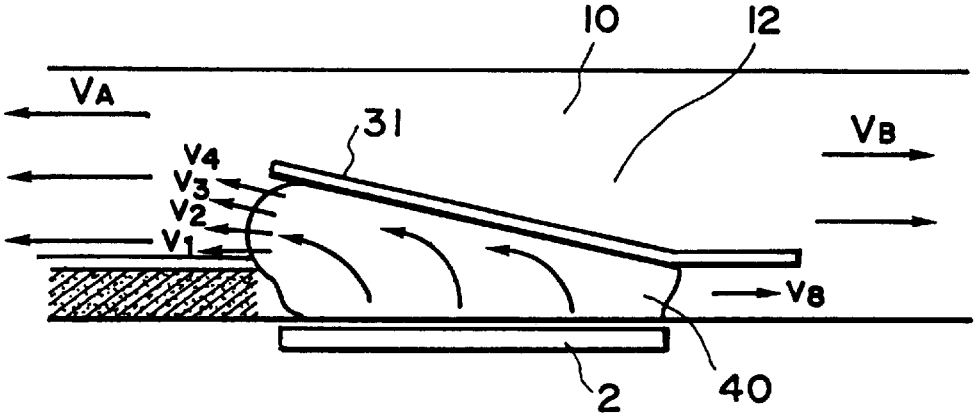
FIG. 5 is a schematic view of pressure propagation from a bubble in a head according to an embodiment of the present invention.

More detailed description will be made with comparison between the conventional liquid flow passage structure not using the movable member (FIG. 4) and the present invention (FIG. 5). Here, the direction of propagation of the pressure toward the ejection outlet is indicated by $V_A$, and the direction of propagation of the pressure toward the upstream is indicated by $V_B$.

In a conventional head as shown in FIG. 4, there is not any structural element effective to regulate the direction of the propagation of the pressure produced by the bubble 40 generation. Therefore, the direction of the pressure propagation of the is normal to the surface of the bubble as indicated by V1–V8, and therefore, is widely directed in the passage. Among these directions, those of the pressure propagation from the half portion of the bubble closer to the ejection outlet (V1–V4) have the pressure components in the $V_A$ direction which is most effective for the liquid ejection.

this portion is important since it directly contributable to the liquid ejection efficiency, the liquid ejection pressure and the ejection speed. Furthermore, the component V1 is closest to the direction of $V_A$ which is the ejection direction, and therefore, is most effective, and the V4 has a relatively small component in the direction $V_A$.

On the other hand, in the case of the present invention, shown in FIG. 5, the movable member 31 is effective to direct, to the downstream (ejection outlet side), the pressure propagation directions V1–V4 of the bubble which otherwise are toward various directions. thus, the pressure propagations of bubble 40 are concentrated, so that the pressure of the bubble 40 is directly and efficiently contributable to the ejection.

The growth direction per se of the bubble is directed downstream similarly to to the pressure propagation directions V1–V4, and grow more in the downstream side than in the upstream side. Thus, the growth direction per se of the bubble is controlled by the movable member, and the pressure propagation direction from the bubble is controlled thereby, so that the ejection efficiency, ejection force and ejection speed or the like are fundamentally improved.

Referring back to FIG. 2, the ejecting operation of the liquid ejecting head in this example will be described in detail.

FIG. 2(*a*) shows a state before the energy such as electric energy is applied to the heat generating element 2, and therefore, no heat has yet been generated. It should be noted that the movable member 31 is so positioned as to be faced at least to the downstream portion of the bubble generated by the heat generation of the heat generating element. In other words, in order that the downstream portion of the bubble acts on the movable member, the liquid flow passage structure is such that the movable member 31 extends at least to the position downstream (downstream of a line passing through the center 3 of the area of the heat generating element and perpendicular to the length of the flow path) of the center 3 of the area of the heat generating element.

FIG. 2(*b*) shows a state wherein the heat generation of heat generating element 2 occurs by the application of the electric energy to the heat generating element 2, and a part of of the liquid filled in the bubble generation region 11 is heated by the thus generated heat so that a bubble is generated through the film boiling.

At this time, the movable member 31 is displaced from the first position to the second position by the pressure produced by the generation of the bubble 40 so as to guide the propagation of the pressure toward the ejection outlet. It should be noted that, as described hereinbefore, the free end 32 of the movable member 31 is disposed in the downstream side (ejection outlet side), and the fulcrum 33 is disposed in the upstream side (common liquid chamber side), so that at least a part of the movable member is faced to the downstream portion of the bubble, that is, the downstream portion of the heat generating element.

FIG. 2(*c*) shows a state in which the bubble 40 has further grown. by the pressure resulting from the bubble 40 generation, the movable member 31 is displaced further. The generated bubble grows more downstream than upstream, and it expands greatly beyond a first position (broken line position) of the movable member.

As the movable member 31 gradually moves in response to the growth of the bubble 40 as described above, the bubble 40 is controlled so that it grows in the direction in which the pressure generated by the bubble 40 can easily escape or be released, and in which the bubble 40 easily shifts in volumetric terms. In other words, the growth of the bubble is uniformly directed toward the free end of the movable member. This also is thought to contribute to the improvement of the ejection efficiency.

Thus, it is understood that in accordance with the growth of the bubble 40, the movable member 10 31 gradually displaces, by which the pressure propagation direction of the bubble 40, the direction in which the volume movement is easy, namely, the growth direction of the bubble, are directed uniformly toward the ejection outlet, so that the ejection efficiency is increased. When the movable member guides the bubble and the bubble generation pressure toward the ejection outlet, it hardly obstructs propagation and growth, and can efficiently control the propagation direction of the pressure and the growth direction of the bubble in accordance with the degree of the pressure.

FIG. 2(*d*) shows a state wherein the bubble 40 contracts and disappears by the decrease of the pressure in the bubble, peculiar to the film boiling phenomenon.

The movable member 31 having been displaced to the second position returns to the initial position (first position) of FIG. 2(*a*) by the restoring force provided by the spring property of the movable member per se and the negative pressure due to the contraction of the bubble. Upon the collapse of bubble, the liquid flows back from the common liquid chamber side as indicated by $V_{D1}$ and $V_{D2}$ and from the ejection outlet side as indicated by $V_C$ so as to compensate for the volume reduction of the bubble in the bubble generation region 11 and to compensate for the volume of the ejected liquid.

In the foregoing, the description has been made as to the operation of the movable member with the generation of the bubble and the ejecting operation of the liquid. now, the description will be made as to the refilling of the liquid in the liquid ejecting head usable with the present invention.

Referring to FIG. 2, liquid supply mechanism will be described.

When the bubble 40 enters the bubble collapsing process after the maximum volume thereof after FIG. 2(*c*) state, a volume of the liquid enough to compensate for the collapsing bubbling volume flows into the bubble generation region from the ejection outlet 18 side of the first liquid flow path 14 and from the bubble generation region of the second liquid flow path 16.

In the case of conventional liquid flow passage structure not having the movable member 31, the amount of the liquid from the ejection outlet side to the bubble collapse position and the amount of the liquid from the common liquid chamber thereinto, are attributable to the flow resistances of the portion closer to the ejection outlet than the bubble generation region and the portion closer to the common liquid chamber.

Therefore, when the flow resistance at the supply port side is smaller than the other side, a large amount of the liquid flows into the bubble collapse position from the ejection outlet side with the result that the meniscus retraction is large. With the reduction of the flow resistance in the ejection outlet for the purpose of increasing the ejection efficiency, the meniscus M retraction increases upon the collapse of bubble with the result of longer refilling time period, thus making high speed printing difficult.

According to this embodiment, because of the provision of the movable member 31, the meniscus retraction stops at the time when the movable member returns to the initial position upon the collapse of bubble, and thereafter, the supply of the liquid to fill a volume W2 is accomplished by the flow $V_{D2}$ through the second flow path 16 (W1 is a volume of an upper side of the bubble volume W beyond the first position of the movable member 31, and W2 is a volume of a bubble generation region 11 side thereof). In the prior art, a half of the volume of the bubble volume W is the volume of the meniscus retraction, but according to this embodiment, only about one half (W1) is the volume of the meniscus retraction.

Additionally, the liquid supply for the volume W2 is forced to be effected mainly from the upstream ($V_{D2}$) of the second liquid flow path along the surface of the heat generating element side of the movable member 31 using the pressure upon the collapse of bubble, and therefore, more speedy refilling action is accomplished.

When the refilling using the pressure upon the collapse of bubble is carried out in a conventional head, the vibration of the meniscus is expanded with the result of the deterioration of the image quality. however, according to this embodiment, the flows of the liquid in the first liquid flow path 14 at the ejection outlet side and the ejection outlet side of the bubble generation region 11 are suppressed, so that the vibration of the meniscus is reduced.

Thus, according to this embodiment, the high speed refilling is accomplished by the forced refilling to the bubble generation region through the liquid supply passage 12 of the second flow path 16 and by the suppression of the meniscus retraction and vibration. therefore, the stabilization of ejection and high speed repeated ejections are accomplished, and when the embodiment is used in the field of recording, the improvement in the image quality and in the recording speed can be accomplished.

The embodiment provides the following effective function. It is a suppression of the propagation of the pressure to the upstream side (back wave) produced by the generation of the bubble. The pressure due to the common liquid chamber 13 side (upstream) of the bubble generated on the heat generating element 2 mostly has resulted in force which pushes the liquid back to the upstream side (back wave). The back wave deteriorates the refilling of the liquid into the liquid flow path by the pressure at the upstream side, the resulting motion of the liquid and the resulting inertia force. In this embodiment, these actions to the upstream side are suppressed by the movable member 31, so that the refilling performance is further improved.

The description will be made as to a further characterizing feature and the advantageous effect.

The second liquid flow path 16 of this embodiment has a liquid supply passage 12 having an internal wall substantially flush with the heat generating element 2 (the surface of the heat generating element is not greatly stepped down) at the upstream side of the heat generating element 2. With this structure, the supply of the liquid to the surface of the heat generating element 2 and the bubble generation region 11 occurs along the surface of the movable member 31 at the position closer to the bubble generation region 11 as indicated by $V_{D2}$. Accordingly, stagnation of the liquid on the surface of the heat generating element 2 is suppressed, so that precipitation of the gas dissolved in the liquid is suppressed, and the residual bubbles not disappeared are removed without difficulty, and in addition, the heat accumulation in the liquid is not too much. Therefore, the stabilized bubble generation can be repeated at a high speed. In this embodiment, the liquid supply passage 12 has a substantially flat internal wall, but this is not limiting, and the liquid supply passage is satisfactory if it has an internal wall with such a configuration smoothly extended from the surface of the heat generating element that the stagnation of the liquid occurs on the heat generating element, and eddy flow is not significantly caused in the supply of the liquid.

The supply of the liquid into the bubble generation region may occur through a gap at a side portion of the movable member (slit 35) as indicated by $V_{D1}$. In order to direct the pressure upon the bubble generation further effectively to the ejection outlet, a large movable member covering the entirety of the bubble generation region (covering the surface of the heat generating element) may be used, as shown in FIG. 2. then, the flow resistance for the liquid between the bubble generation region 11 and the region of the first liquid flow path 14 close to the ejection outlet is increased by the restoration of the movable member to the first position, so that the flow of the liquid to the bubble generation region 11 along $V_{D1}$ can be suppressed. However, according to the head structure of this embodiment, there is a flow effective to supply the liquid to the bubble generation region, the supply performance of the liquid is greatly increased, and therefore, even if the movable member 31 covers the bubble generation region 11 to improve the ejection efficiency, the supply performance of the liquid is not deteriorated.

Figure 6:
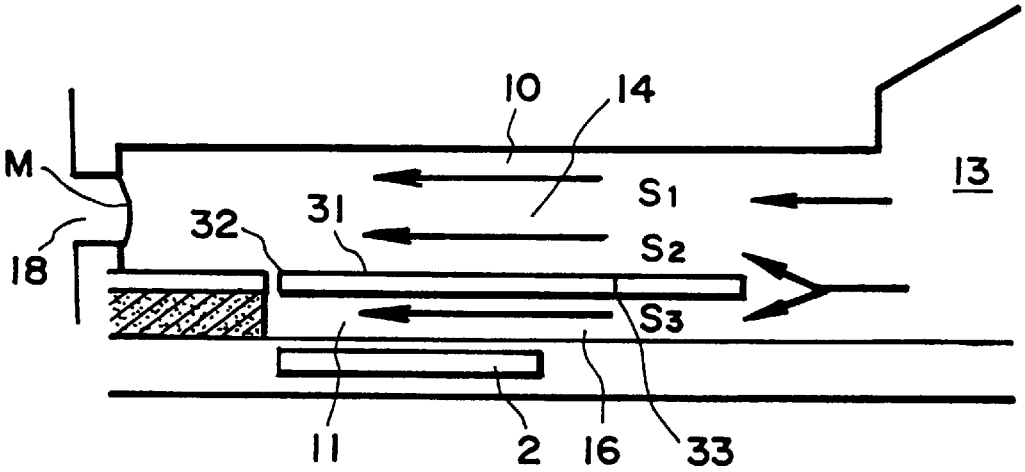
FIG. 6 is a schematic view of a liquid flow in an embodiment of the present invention.

The positional relation between the free end 32 and the fulcrum 33 of the movable member 31 is such that the free end is at a downstream position of the fulcrum as indicated in FIG. 6 for example. With this structure, the function and effect of guiding the pressure propagation direction and the direction of the growth of the bubble to the ejection outlet side or the like can be efficiently assured upon the bubble generation. Additionally, the positional relation is effective to accomplish not only the function or effect relating to the ejection but also the reduction of the flow resistance through the liquid flow path 10 upon the supply of the liquid thus permitting the high speed refilling. When the meniscus M retracted b the ejection as shown in FIG. 6, returns to the ejection outlet 18 by capillary force or when the liquid supply is effected to compensate for the collapse of bubble, the positions of the free end and the fulcrum 33 are such that the flows $S_1$, $S_2$ and $S_3$ through the liquid flow path 10 including the first liquid flow path 14 and the second liquid flow path 16, are not impeded.

More particularly, in this embodiment, as described hereinbefore, the free end 32 of the movable member 3 is faced to a downstream position of the center 3 of the area which divides the heat generating element 2 into an upstream region and a downstream region (the line passing through the center (central portion) of the area of the heat generating element and perpendicular to a direction of the length of the liquid flow path). The movable member 31 receives the pressure and the bubble which are greatly contributable to the ejection of the liquid at the downstream side of the area center position 3 of the heat generating element, and it guides the force to the ejection outlet side, thus fundamentally improving the ejection efficiency or the ejection force.

Further advantageous effects are provided using the upstream side of the bubble, as described hereinbefore.

Furthermore, it is considered that in the structure of this embodiment, the instantaneous mechanical movement of the free end of the movable member 31, contributes to the ejection of the liquid.

Embodiment 1

Figure 7:
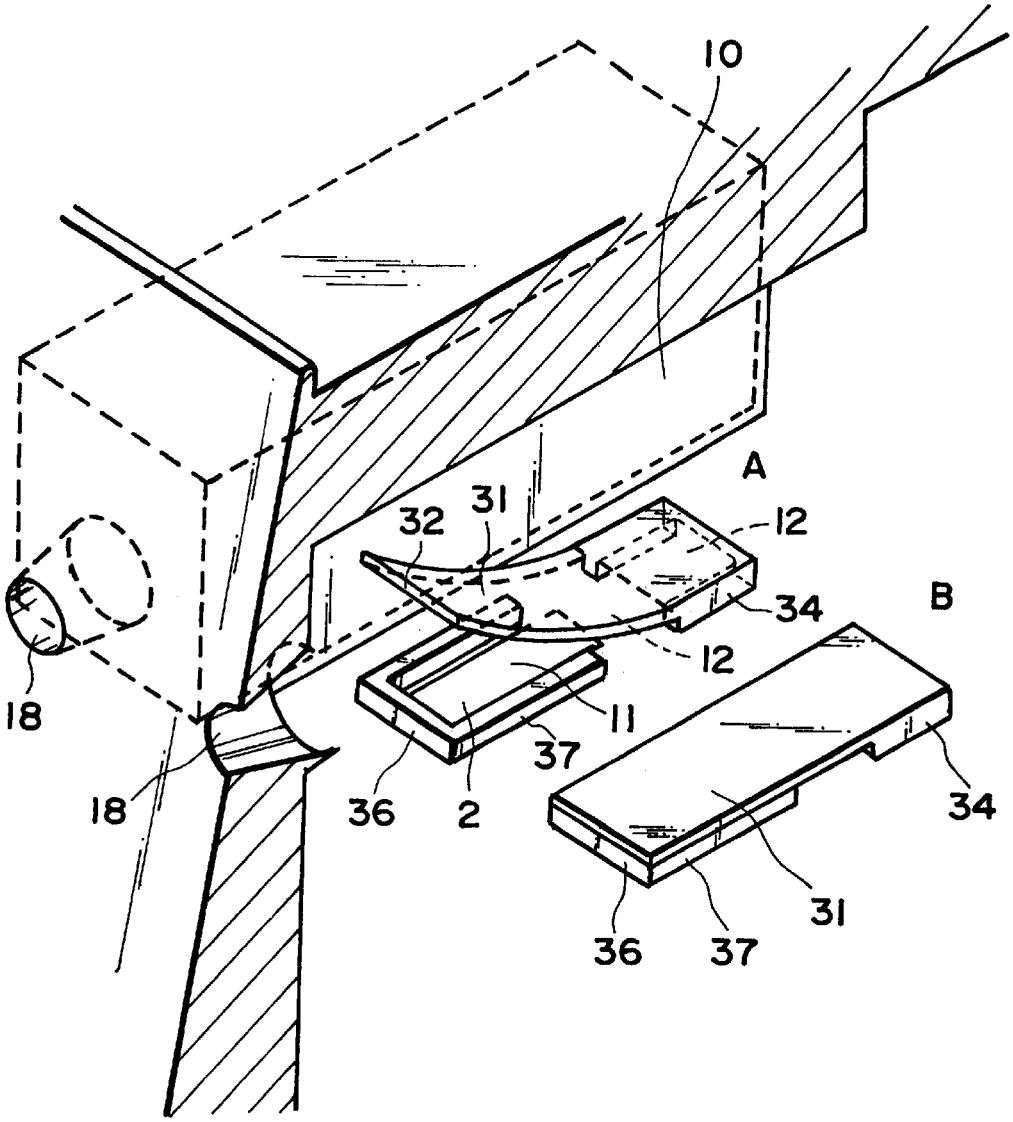
FIG. 7 depicts the essential portion of the liquid ejection head in the first embodiment of the present invention.
Figure 8A:
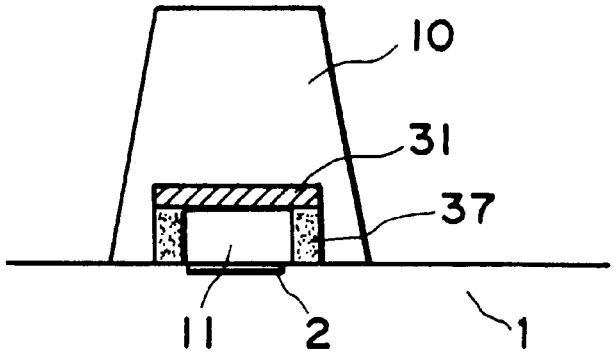
FIGS. 8(*a–d*) are schematic drawings for describing the principal operation of the liquid ejection head during the contraction-vanishment of the bubble.
Figure 8B:
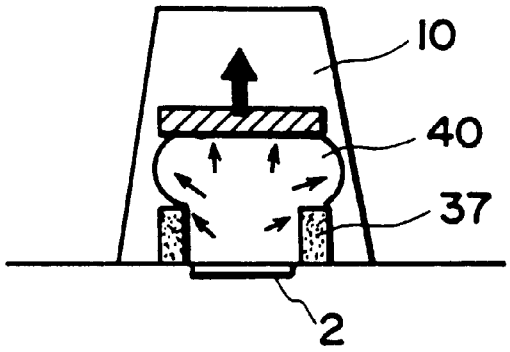
Figure 8C:
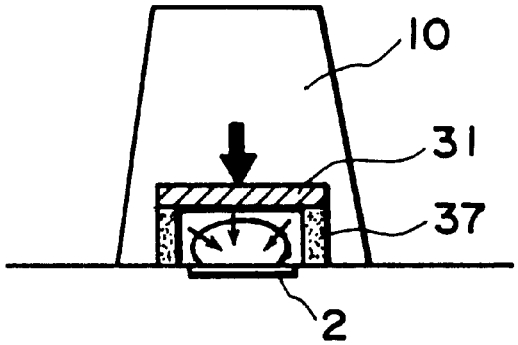
Figure 8D:
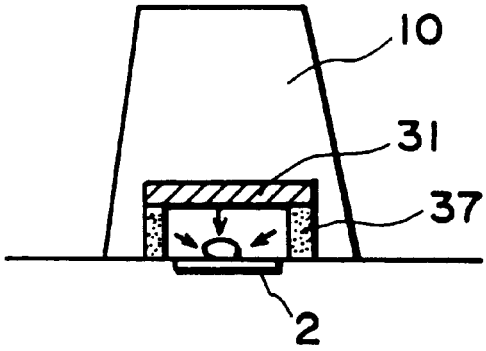

FIG. 7 shows a first embodiment. In FIG. 7, A shows an upwardly displaced movable member although bubble is not shown, and B shows the movable member in the initial position (first position) wherein the bubble generation region 11 is substantially sealed relative to the ejection outlet 18. Although not shown, there is a flow passage wall between A and B to separate the flow paths.

A foundation 34 is provided at each side, and between them, a liquid supply passage 12 is constituted. With this structure, the liquid can be supplied along a surface of the movable member faced to the heat generating element side and from the liquid supply passage having a surface substantially flush with the surface of the heat generating element or smoothly continuous therewith.

When the movable member 31 is at the initial position (first position), the movable member 31 is close to or closely contacted to a downstream wall 36 disposed downstream of the heat generating element 2 and heat generating element side walls 37 disposed at the sides of the heat generating element, so that the ejection outlet 18 side of the bubble generation region 11 is substantially sealed. Thus, the pressure produced by the bubble at the time of the bubble generation and particularly the pressure downstream of the bubble, can be concentrated on the free end side side of the movable member, without releasing the pressure.

In the process of the collapse of bubble, the movable member 31 returns to the first position, and the ejection outlet side of the bubble generation region 31 is substantially sealed, and therefore, the meniscus retraction is suppressed, and the liquid supply to the heat generating element is carried out with the advantages described hereinbefore. As regards the refilling, the same advantageous effects can be provided as in the foregoing example.

In particular, in this embodiment, regulating means (wall 36 on the downstream side of the heat generation member, and walls along the heat generation member) are provided, which regulate the downward movement of the movable member so that when the movable member returns from the second position to the first position, the movable member is prevented from movable past the first position and entering the bubble generation region. In other words, the downward movement of the movable member past the first position, that is, an excessive movement of the movable member is prevented; therefore, the durability of the movable member is further improved.

Referring to FIG. 8, the characteristics of the embodiment of the present invention will be described in more detail.

FIG. 8 is a schematic section of the liquid passage 10 of a liquid ejection head, at a point within the bubble generation region 11. It sequentially depicts the operation of the liquid ejection head.

FIG. 8(*a*) depicts the state before the operation begins, in which the movable member is at the first position (initial position). In this state, the free end portion of the movable member is in contact with the aforementioned regulating means, being physically prevented from moving downward.

FIG. 8(*b*) depicts the state in which the movable member 31 is being moved by the pressure of the bubble developed by the heat from the heating member. Thereafter, as the bubble contracts, the movable member returns to the first position due to the negative pressure generated by the contraction of the bubble, and the elastic resilience of the movable member itself.

At the same time, the downward movement of the free end portion of the movable member is regulated by the aforementioned regulating means; the free end portion of the movable member is prevented from moving downward beyond the first position.

The ejection outlet side of the heat generation region 11 is substantially sealed by the wall 36 which is located on the downstream side of the heat generating member and also functions as the regulating means, the walls 37 located along the heat generating member, and the movable member 31; therefore, the negative pressure in the bubble generation region is increased by the continuous contraction of the bubble (FIG. 8(*d*)). However, this negative pressure is canceled by the incoming recharging ink, preventing the deformation of the movable member.

In this embodiment, the foundation 34 for supporting and fixing the movable member 31 is provided at an upstream position away from the heat generating element 2, as shown in FIG. 3 and FIG. 7, and the foundation 34 has a width smaller than the liquid flow path 10 to supply the liquid to the liquid supply passage 12. The configuration of the foundation 34 is not limited to this structure, but may be anyone if smooth refilling is accomplished.

In this embodiment, the clearance between the movable member 31 and the clearance is 15 $\mu$m approx., but the distance may be changed as long as the pressure produced by the bubble generation is sufficiently propagated to the movable member.

As described above, in this embodiment, the moving member 31, more precisely, the free end portion thereof, is restrained or prevented from moving downward past the first position, by the regulating means such as the wall 36 on the downstream side of the heat generating member, or by the walls 37 along the lateral edges of the heat generating member; therefore, not only the efficiency at which the liquid is refilled is increased as described above, but also, the movement of the free end portion of the moving member is primarily confined to the area above the first position.

Consequently, the bending stress which is generated at the supporting portion due to its deformation is rendered unidirectional; therefore, the durability of the moving member can be drastically improved.

Embodiment 2

Figure 9A:
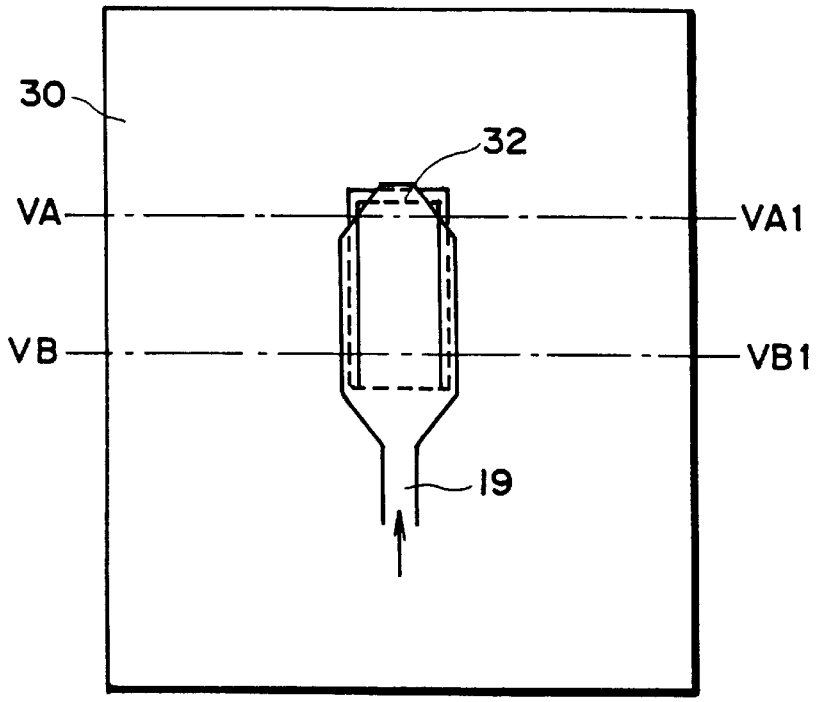
FIGS. 9(*a–c*) depict the essential portion of the liquid ejection head in the second embodiment of the present invention.
Figure 9B:
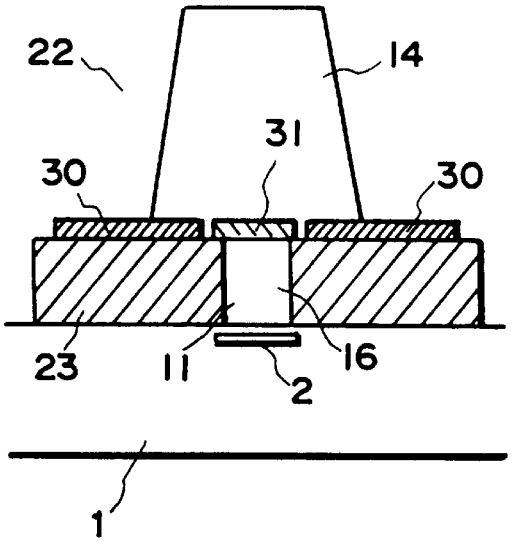
Figure 9C:
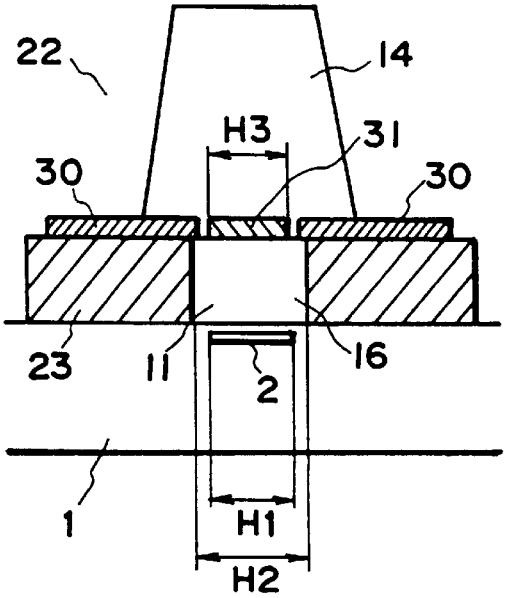

FIG. 9 is a schematic drawing of the liquid ejection head in this embodiment, depicting the structure of the liquid passage; FIG. 9(*a*) is a plan view depicting the positional relationship among a first liquid passage 14, a moving member 31, and a second liquid passage 16; FIG. 9(*b*), a sectional view thereof, at a line VA–VA' in FIG. 9(*a*); and FIG. 9(*c*) is a sectional view at a line VB–VB' in FIG. 9(*a*).

The second liquid passage 16 is provided with a narrow portion or throat 19. This narrow portion 19 is located on the upstream side of the heat generating member 2, forming a chamber structure (bubble generation chamber) capable of preventing the pressure generated by the bubble from escaping through the second liquid passage 16. When a narrow portion is provided in the liquid passage of a conventional liquid ejection head without the moving member in order to prevent the pressure generated on the common liquid chamber side of the heat generating member from escaping toward the common liquid chamber, the narrow portion of the liquid passage must be structured so that the cross-section thereof does not becomes excessively small, in consideration of the efficiency at which the liquid refills the liquid passage from which the liquid has been ejected.

However, in the case of this embodiment, the major portion of the liquid to be ejected comes from the first liquid passage 14; the liquid within the second liquid passage 16 in which the heating member 2 is disposed is consumed only by a small amount. Accordingly, the liquid has to be refilled into the bubble generation region of the second liquid passage 16 only by the amount consumed by the bubble generation. Therefore, the distance between the lateral walls of the narrow portion 9 can be rendered extremely small, for example, from several microns to ten-odd microns, so that it becomes possible to concentrate the pressure from the growing bubble generated in the second liquid passage 16 toward the moving member 31, allowing only a small portion of it to dissipate into the surrounding area. In other words, the moving member 31 makes it possible to use the major portion of this pressure as the ejection pressure; therefore, a better ejection efficiency and a stronger ejection pressure can be obtained.

It should be noted here that the configuration of the second liquid passage 16 is not limited to the one described above. That is, any configuration is acceptable as long as it can allow the pressure from the bubble growth to be effectively directed toward the moving member.

Referring to FIG. 9(*c*), the width of the heating member 2 is designated by a reference H1; the width of the second liquid passage 2, by a reference H2; and the width of the moving member 31 is designated by a reference H3.

According to the present invention, the relationship among these widths is:

$$H2>H1>H3$$

When the moving member 31 is at the position illustrated in FIG. 9(*c*), it appears as if there is nothing to prevent the downward movement of the moving member therefrom. However, since the portion of the second liquid passage 16, which is immediately below the free end of the cantilever type moving member 31, is tapered, the moving member 31 comes in contact with the walls 23 of the second liquid passage 16, by its free end 32, as it returns to the first position. In other words, the downward movement of the free end is regulated by the walls 23 of the second liquid passage 16 which doubles as the regulating means. Therefore, the durability of the moving member is improved, and at the same time, the ejection efficiency and the ink recharge efficiency can be improved.

Embodiment 3

Figure 10A:
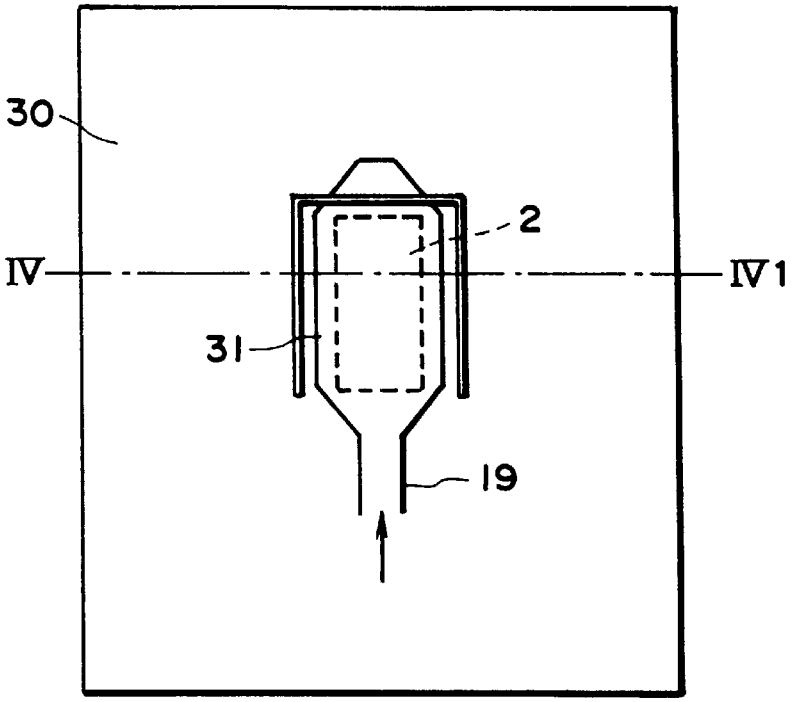
FIGS. 10(*a*) and 10(*b*) depict the essential portion of the liquid ejection head in the third embodiment of the present invention.
Figure 10B:
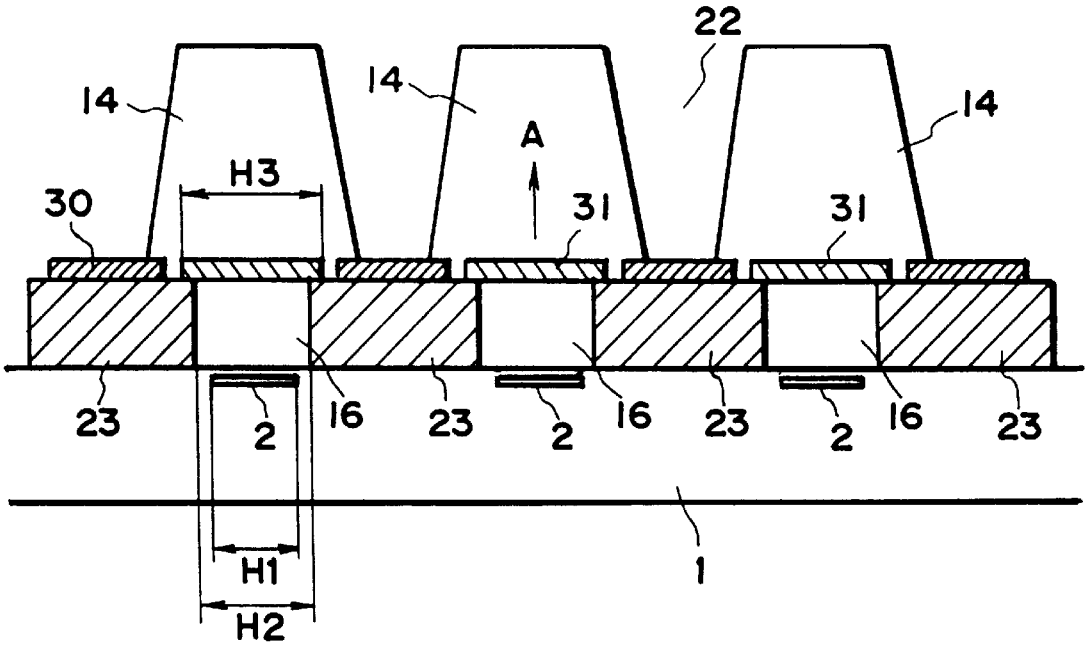

FIG. 10(*a*) is a plan view for describing the positional relationship among the aforementioned first liquid passage 14, moving member 31, and second liquid passage 16, and FIG. 10(*b*) is a sectional view thereof along a line IV–IV' in FIG. 10(*a*).

In these drawings, the natural position of the moving member (that is, the position at which the moving member 31 is not in action) is designated as the first position. When the moving member 31 is at the first position, at least a portion (a part of the side portion and a part of the free end in this embodiment) of the edge of the moving member 31 is in contact with the liquid passage walls 23 which form the second liquid passage 16. Therefore, when the moving member having moved as indicated by an arrow mark A from the natural (initial) position returns to the natural (initial) position, it does not move into the second liquid passage 16 because it is blocked by the liquid passage walls 23. Further, in this embodiment, the moving member 31 is rendered wider than the heater. In other words, the relationship among the width H1 of the heating member 2, the width H2 of the second liquid passage 16, and the width H3 of the moving member 31 is:

$$H3>H2$$

Moreover, when the relationship between H1 and H2 satisfies: H2>H1, the margin for component positioning error can be increased.

In this embodiment, the returning movement of the moving member to the initial position is stabilized by satisfying the above relationships, making it possible to maintain a far more stable state of liquid ejection compared to the conventional system. As a result, it is possible to obtain a liquid ejection head which is far superior to the conventional one in ejection efficiency and durability.

Embodiment 4

Figure 12:
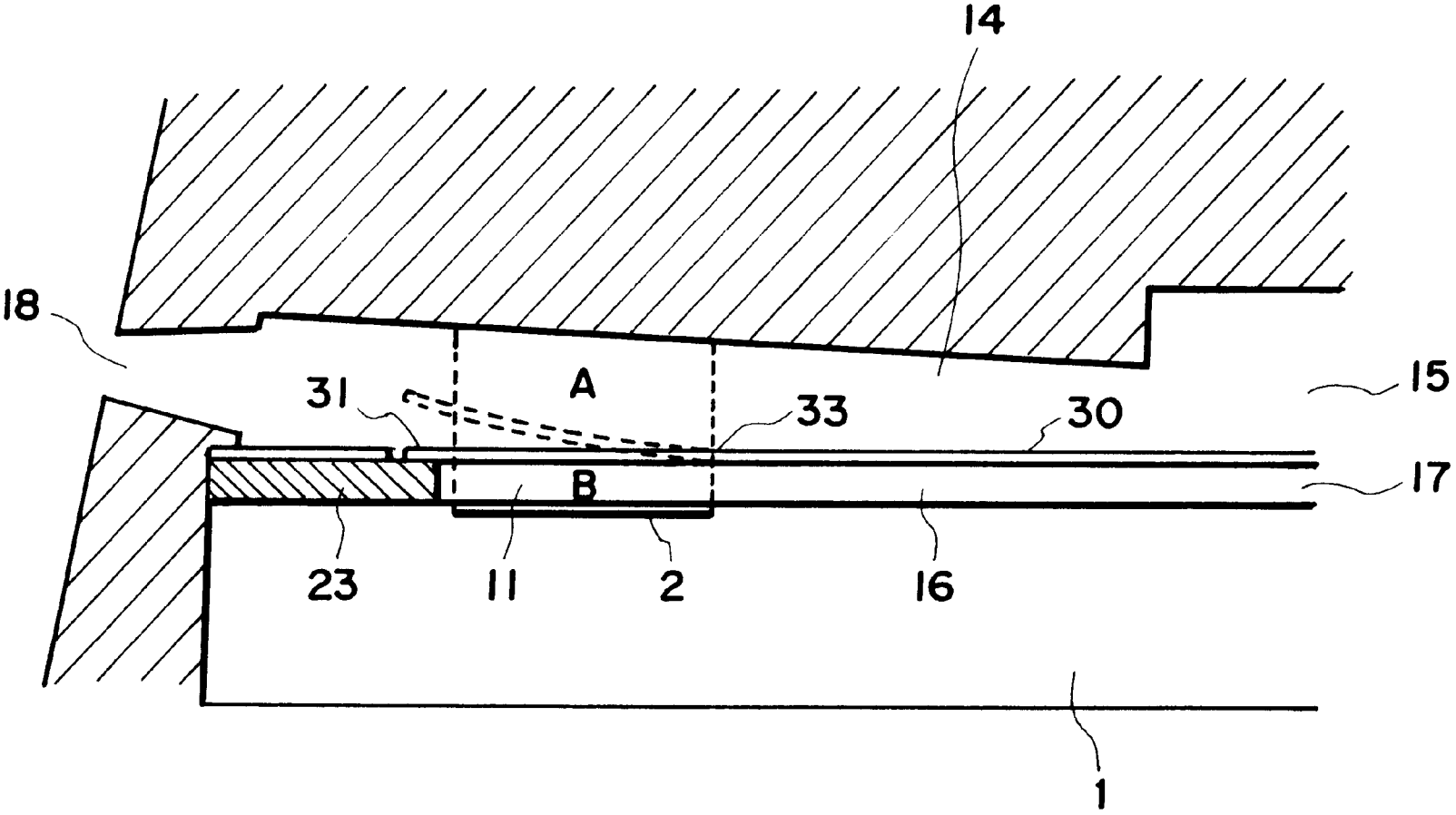
FIG. 12 is a cross-sectional view of the liquid ejection head (second liquid passage) in the fourth embodiment of the present invention.

FIGS. 11 and 12 depict the fourth embodiment of the present invention.

FIG. 11(*a*) is a plan view depicting the positional relationship among the moving member 31, the second liquid passage 16, and the heating member 2. FIG. 11(*b*) is a sectional view thereof, at a line A—A illustrated in FIG. 11(*a*), wherein the moving member 31 is at the initial position.

FIG. 12 is a longitudinal sectional view taken along a line B—B illustrated in FIG. 11(*a*), and depicts the area from the position of the ejection orifice to the common liquid chamber.

In the liquid ejecting head of this embodiment, a second liquid flow path 16 for the bubble generation is provided on the element substrate 1 which is provided with a heat generating element 2 for supplying thermal energy for generating the bubble in the liquid, and a first liquid flow path 14 for the ejection liquid in direct communication with the ejection outlet 18 is formed thereabove.

The upstream side of the first liquid flow path is in fluid communication with a first common liquid chamber 15 for supplying the ejection liquid into a plurality of first liquid flow paths, and the upstream side of the second liquid flow path is in fluid communication with the second common liquid chamber for supplying the bubble generation liquid to a plurality of second liquid flow paths.

In the case that the bubble generation liquid and ejection liquid are the same liquids, the number of the common liquid chambers may be one.

Between the first and second liquid flow paths, there is a separation wall 30 of an elastic material such as metal so that the first flow path and the second flow path are separated. In the case that mixing of the bubble generation liquid and the ejection liquid should be minimum, the first liquid flow path 14 and the second liquid flow path 16 are preferably isolated by the partition wall. however, when the mixing to a certain extent is permissible, the complete isolation is not inevitable.

A portion of the partition wall in the upward projection space of the heat generating element (ejection pressure generation region including A and B (bubble generation region 11) in FIG. 12), is in the form of a cantilever movable member 31, formed by slits 35, having a fulcrum 33 at the common liquid chamber (15 17) side and free end at the ejection outlet side (downstream with respect to the general flow of the liquid). The movable member 31 is faced to the surface, and therefore, it operates to open toward the ejection outlet side of the first liquid flow path upon the bubble generation of the bubble generation liquid (direction of the arrow in the Figure). In an example of FIG. 12, too, a partition wall 30 is disposed, with a space for constituting a second liquid flow path, above an element substrate 1 provided with a heat generating resistor portion as the heat generating element 2 and wiring electrodes 5 for applying an electric signal to the heat generating resistor portion.

As for the positional relation among the fulcrum 33 and the free end 32 of the movable member 31 and the heat generating element, are the same as in the previous example.

In the previous example, the description has been made as to the relation between the structures of the liquid supply passage 12 and the heat generating element 2. the relation between the second liquid flow path 16 and the heat generating element 2 is the same in this embodiment.

In particular, the structure of the moving member 31 in this embodiment is such that when the moving member 31 is at the initial position, both lateral edges of the moving member 31, and the entire edge of the free end portion, are in contact with the walls of the second liquid passage, rendering the bubble generation region 11 of the second liquid passage 16 substantially sealed from the first liquid passage 14. With the presence of such a structure, the downward movement of the moving member 31 is prevented by all of the edges. As a result, the bending stress which occurs at the supporting point is more effectively confined to a single direction. Consequently, the durability of the moving member is improved.

Further, since all the edges of the moving member come in contact with the walls 23 which form the second liquid passage 16, the pressure from the bubble generation is not allowed to escape into the first liquid passage through the gap; the pressure is further concentrated on the moving member. Therefore, it is possible to provide a liquid ejection head with a far higher ejection efficiency and a far stronger ejection force.

Further, in the case of a liquid ejection head in which the partitioning wall, a part of which constitutes the moving member, is extended through the common liquid chamber to partition the common liquid chamber into two common liquid chambers 15 and 17, different liquids, for example, liquid to be primarily elected, and liquid for primarily generating the bubble, can be supplied to the first liquid passage 14 and the second liquid passage 16, respectively. With this arrangement, even liquid which is difficult to boil, liquid which is susceptible to heat, or the like liquid, can be ejected in a preferable manner.

Further, when the moving member of this embodiment is at the initial position, the first and second liquid passages 14 and 16 are substantially sealed from each other. In other words, the liquid is prevented from moving between the two liquid passages; therefore, the mutual diffusion of the two different liquids, which might occur when the liquid ejection head is not in action, can be prevented.

The major functions and effects as regards the propagation of the bubble generation pressure with the displacement of the movable wall, the direction of the bubble growth, the prevention of the back wave and so on, in this embodiment, are the same as with the first embodiment, but the two-flow-path structure is advantageous in the following points.

The ejection liquid and the bubble generation liquid may be separated, and the ejection liquid is ejected by the pressure produced in the bubble generation liquid. Accordingly, a high viscosity liquid such as polyethylene glycol or the like with which bubble generation and therefore ejection force is not sufficient by heat application, and which has not been ejected in good order, can be ejected. for example, this liquid is supplied into the first liquid flow path, and liquid with which the bubble generation is in good order is supplied into the second path as the bubble generation liquid. An example of the bubble generation liquid a mixture liquid (1–2 cP approx.) of the anol and water (4:6). by doing so, the ejection liquid can be properly ejected.

Additionally, by selecting as the bubble generation liquid a liquid with which the deposition such as kogation does not remain on the surface of the heat generating element even upon the heat application, the bubble generation is stabilized to assure the proper ejections. The above-described effects in the foregoing embodiments are also provided in this embodiment, the high viscous liquid or the like can be ejected with a high ejection efficiency and a high ejection pressure.

Furthermore, liquid which is not durable against heat is ejectable. in this case, such a liquid is supplied in the first liquid flow path as the ejection liquid, and a liquid which is not easily altered in the property by the heat and with which the bubble generation is in good order, is supplied in the second liquid flow path. by doing so, the liquid can be ejected without thermal damage and with high ejection efficiency and with high ejection pressure.

Embodiment 5

Figure 13A:
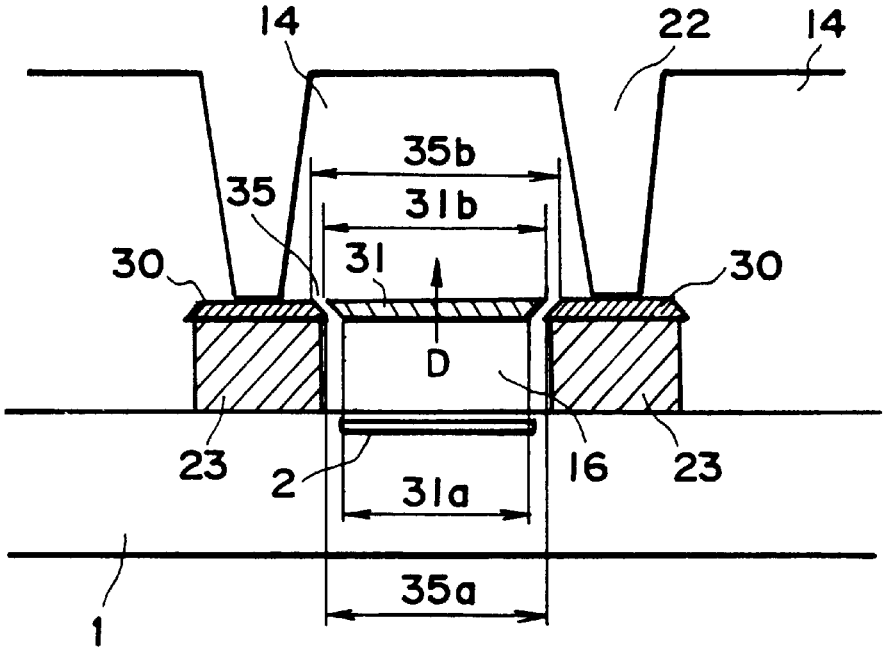
FIGS. 13(*a*) and 13(*b*) depict the essential portion of the liquid ejection head in the fifth embodiment of the present invention.
Figure 13B:
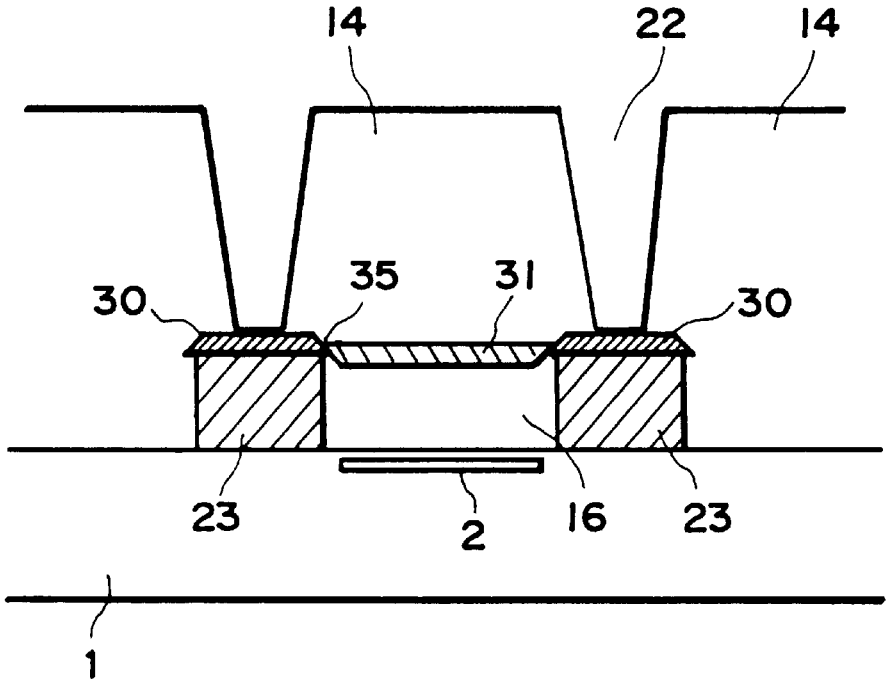

FIG. 13 is a schematic cross-sectional view of the liquid ejection head in this embodiment, and depicts the structure thereof; FIG. 13(*a*) depicts the movement of the movable member, which is triggered as a driving pulse is applied; and FIG. 13(*b*) depicts the state in which the driving pulse was turned off and the movable member has returned to the natural position from the position to which it had moved. As is evident from these drawings, the cross-section of the movable member 31 is shaped like an inverted trapezoid. Further, the edge of the partition wall 30, which faces the slit 35, is slanted to match the cross-section of the movable member 31. In other words, the width 31*a* of the movable member 31, on the side of the second liquid passage 15, is less than the width 31*b* of the movable member 31, on the side of the first liquid passage 14. Conversely, the width 31*b* of the movable member 31, on the side of the first liquid passage 14, is less than the distance 35*b* between the opposing lateral edges of the partition wall 30, on the side of the first liquid passage 14, and is greater than the distance 35*a* between the opposing lateral edges of the partition wall 30, on the side of the second liquid passage 16: $35b \geqq 35a$.

As the movable member returns to the initial position, it tends to move downward past the initial position due to the negative pressure within the second liquid passage and the elastic resiliency of the movable member itself, but in this embodiment, the slanted lateral surfaces of the movable member and the corresponding slanted surfaces of the partition wall 30 come in contact with each other, regulating the downward movement of the movable member; the downward movement on the movable member past the initial position is confined within a range equivalent to the width of the movable member 31. Therefore, the durability of the movable member is improved even though the structure of this embodiment is such that there is no specific stopper provided for the free end of the movable member.

It is obvious that when the end surface of the free end of the movable member, and the correspondent surface of the partition wall, are slanted in the same manner as described above, the same effect as those described in the preceding embodiments can be obtained.

Further, in this embodiment, the invasion of the movable member 31 into the second liquid passage 14 is prevented by the partition wall 30 itself; therefore, the manufacturing steps can be simplified.

Embodiment 6

Figure 14A:
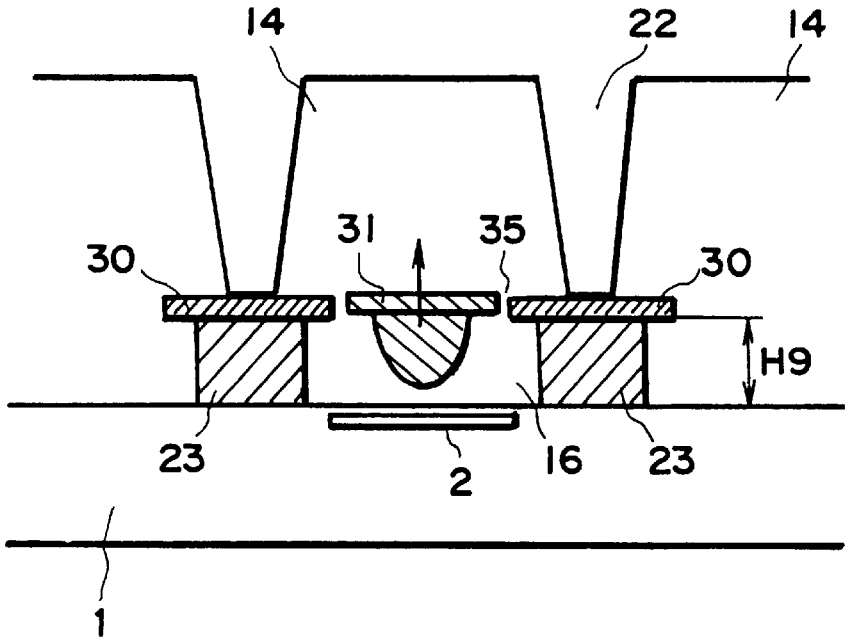
FIGS. 14(*a*) and 14(*b*) depict the essential portion of the liquid ejection head in the sixth embodiment of the present invention.
Figure 14B:
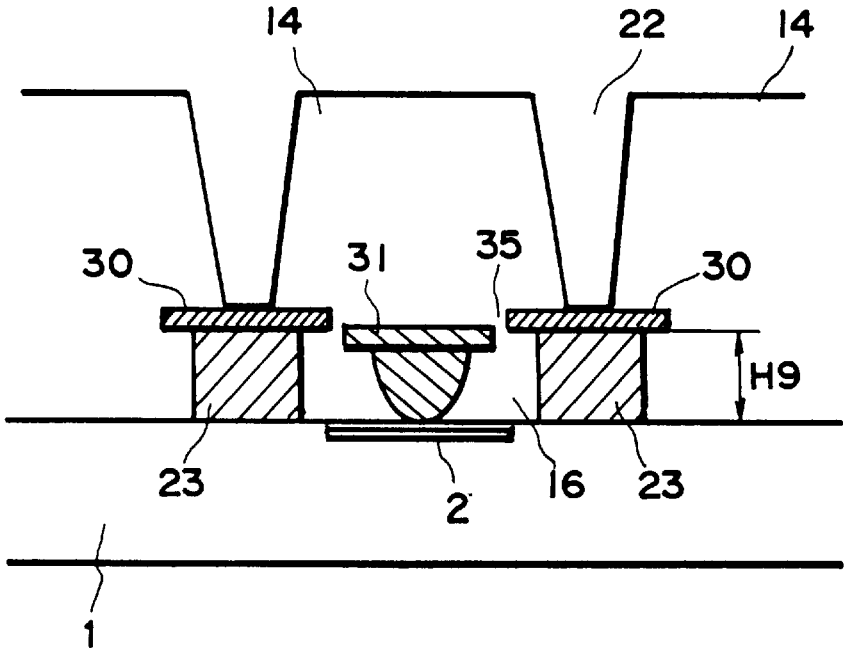

FIG. 14 is a schematic cross-section of the liquid passage of the liquid ejection head in this embodiment, and depicts its structure; FIG. 14(*a*) depicts the state in which the movable member is ready to move into the first liquid passage as a driving pulse is applied to the heating member 2; and FIG. 14(*b*) depicts the state in which the driving pulse was turned off and the movable member has returned to the first position from the position to which it had moved. The configuration of the movable member in this embodiment is such that it is flat on the surface, on the side of the first liquid passage 14, and has a projection, on the surface on the side of the second liquid passage 16. The height of this projection is no greater than the height H9 of the partition wall 23.

As a driving pulse is applied, the movable member 31 with the projection is moved in the direction indicated by an arrow mark, because of the bubble generated on the heater 2 (FIG. 14(*a*)).

Thereafter, as the driving pulse is turned off, the bubble vanishes, allowing the movable member 31 to return to the first position where the slit 35 is maintained between the movable member and the opposing lateral edges of the partition wall 30. At this moment, the movable member 31 tends to move into the second liquid passage 16, due to the negative pressure generated by the vanishing bubble and the elastic resilience of the movable member itself, but its movement into the second liquid passage 10 is regulated by the projection formed on the movable member 31; the downward movement of the movable member 31 past the first position is confined within the range equivalent to the thickness of the movable member itself (FIG. 14(*b*)).

Embodiment 7

Figure 15:
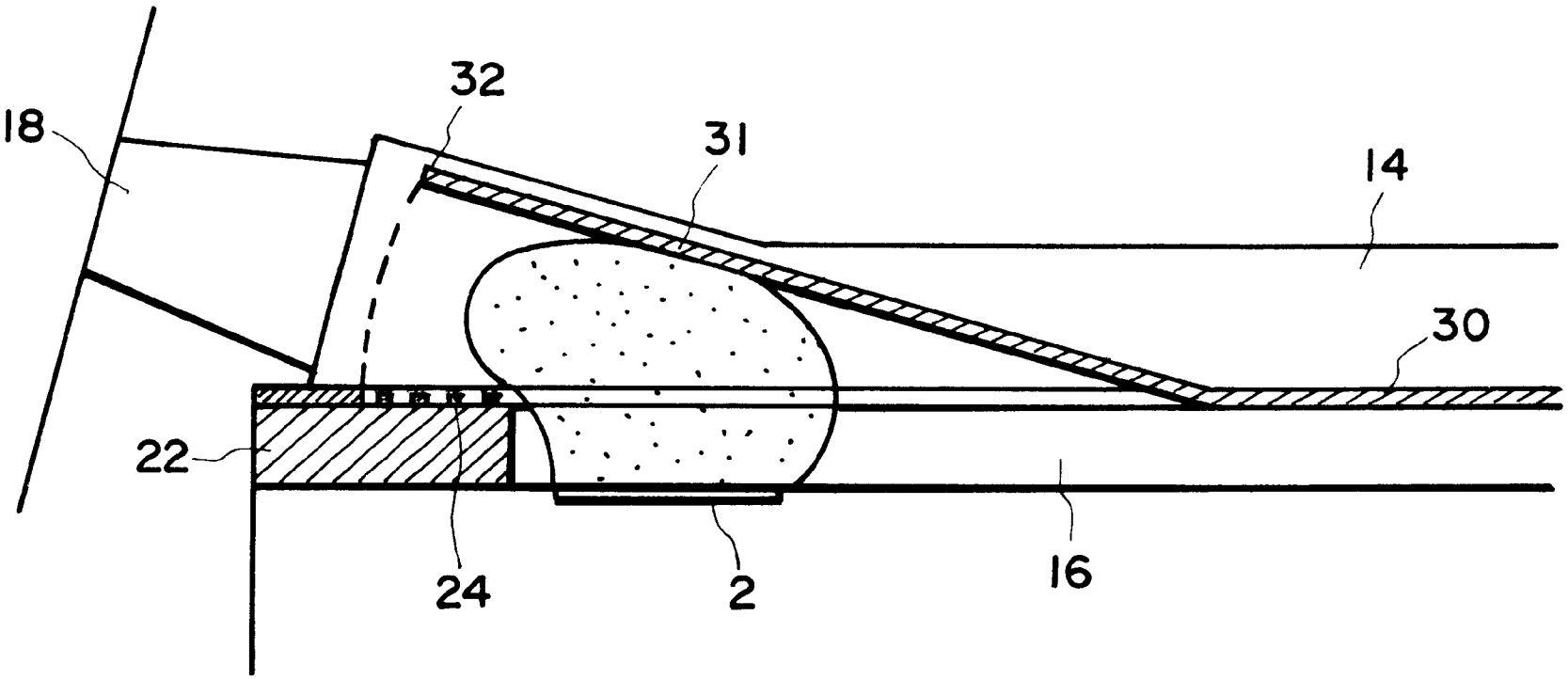
FIG. 15 depicts the essential portion of the liquid ejection head in the seventh embodiment of the present invention.

FIG. 15 is a schematic, longitudinal section of the liquid passage of the liquid ejection head in this embodiment, and depicts its structure. This drawing depicts the state in which the movable member 31 is moved by the bubble, which was generated in the liquid within the second liquid passage by the heat generated by the heater 2.

The basic structure of the liquid ejection head in this embodiment is the same as that in the fourth embodiment, except that the free end 32 of the movable member 31 in this embodiment is extended beyond the corresponding end of the heat generating member 2 in the direction of the ejection orifice, and that plural projections are provided on the liquid passage wall 23 constituting a part of the bottom surface of the first liquid passage 14, in the area in which the free end portion of the movable member 31 makes contact with the bottom surface of the first liquid passage 14. These projections 14 prevent the movable member 31, which comes in contact with the liquid passage wall 23, from sticking to the liquid passage wall 23. Needless to say, the location where these projections 24 are positioned is not limited to the area correspondent to the free end portion of the movable member 31; other areas are acceptable. Obviously, they may be provided on the movable member 31 itself.

Further, in order to increase the amount of the movable member displacement without rendering it excessive, the liquid passage ceiling level above the free end portion of the movable member 31 is raised higher than the liquid ceiling level above the supporting portion. It should be noted here that the liquid passage configuration described above is not limited to this embodiment; the application of this configuration to other embodiments similarly improves the durability of the movable member.

Embodiment 8

Figure 16:
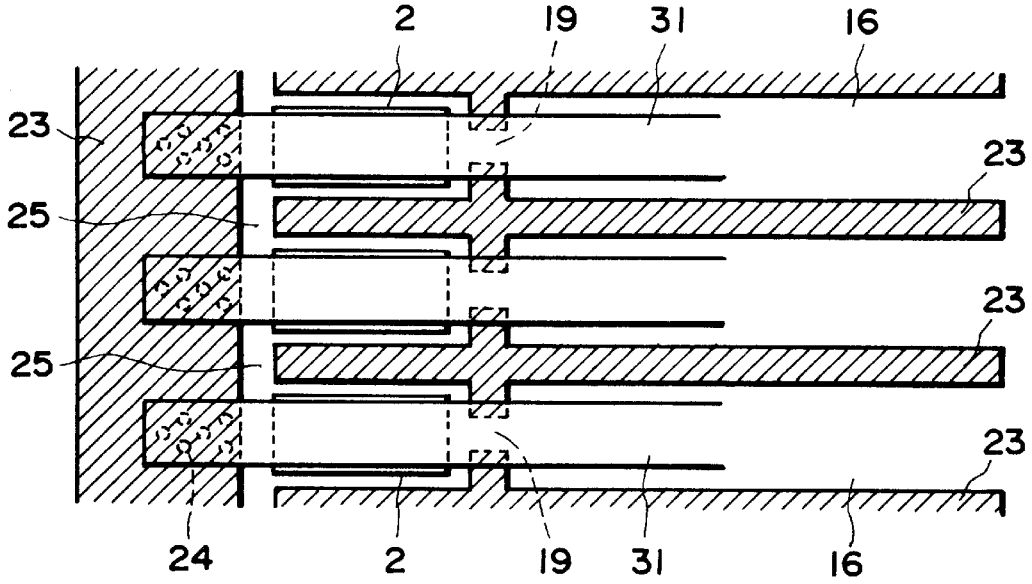
FIG. 16 depicts the essential portion of the liquid ejection head in the eighth embodiment of the present invention.

FIG. 16 is a schematic plan view of the liquid passages of the liquid ejection head in this embodiment, and depicts their structures. In the drawing, a reference numeral 2 designates a heat generating member; a reference numeral 14, a second liquid passage; a reference numeral 23, a liquid passage wall; and a reference numeral 24 designates a projection.

Also in this embodiment, plural projections 24 are provided on the liquid passage wall 23 constituting the bottom surface of the first liquid passage 14, in the area with which the free end portion of the movable member 31 makes contact. The configuration of the second liquid passage 16 is affected by the liquid passage wall 23; a narrow portion is formed. Further, a liquid passage wall 19 is partially cut away, and a passage 25 is provided to connect the adjacent second liquid passages 16 at their downstream side ends. A partition wall (Ni plate) 30, a part of which constitutes the movable member 31, is laminated onto the liquid passage wall 23 patterned as described above, covering the second liquid passage 16 in such a manner that the tip of the movable member 31 makes contact with the liquid passage wall 23.

Embodiment 8

Figure 17:
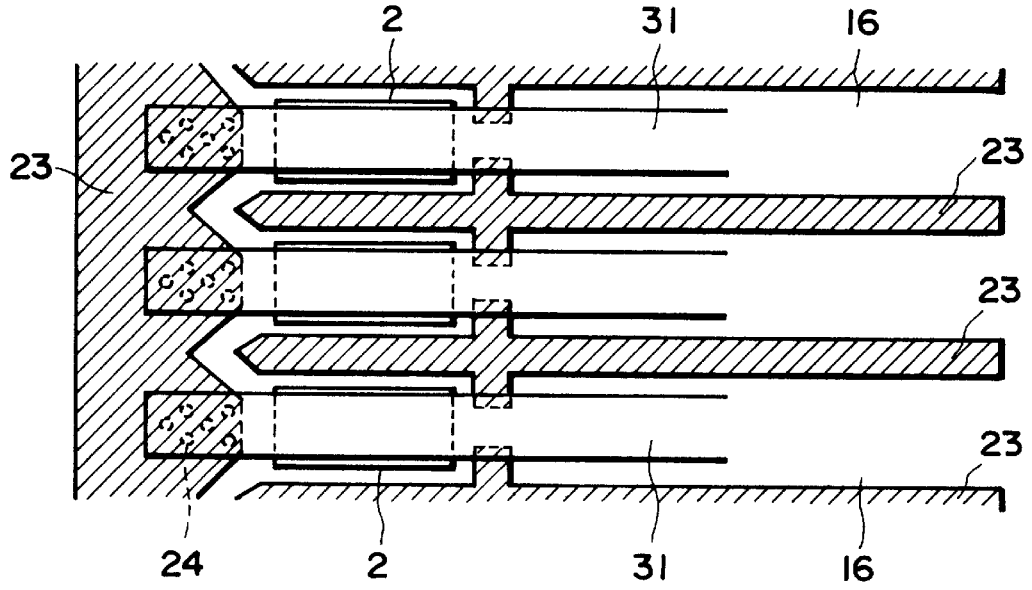
FIG. 17 depicts the essential portion of the liquid ejection head in the ninth embodiment of the present invention.

FIG. 17 is a schematic plan view of the liquid passage of the liquid ejection head in this embodiment, and depicts its structure. Also in this embodiment, a passage 25 connecting the adjacent second liquid passages 16 as described in the eighth embodiment is provided though it is slightly different; the passage 25 in this embodiment is made to run in zigzag. Therefore, the length of the connecting passage 25 between the adjacent second liquid passages 16 becomes longer, rendering the liquid ejection head more resistant to cross-talk.

As is evident from the preceding embodiments, according to the present invention, the movement (downward displacement) of the free end of the movable member from the first position into the bubble generation region (toward the heat generating member past the first position) is regulated; therefore, the stress which occurs in the supporting portion of the movable member is rendered unidirectional. Consequently, the durability of the movable member is drastically improved.

Further, the meniscus vibration is suppressed to a minimum, and therefore, the negative pressure, which is generated in the bubble generation region as the bubble vanishes, is more effectively utilized to recharge the liquid passage with liquid. As a result, the liquid passages can be recharged at a higher frequency.

Further, when the movable member is at the first position, it contacts the regulating means, or maintains a slight gap therefrom, that is, there is no gap in practical terms between the movable member and the regulating means; therefore, the generated bubble does not escape through the gap (slit) between the two components, fully acting on the movable member. Accordingly, it is possible to produce a liquid ejection head with a higher ejection efficiency and a higher ejection force.

According to another aspect of the present invention, when the movable member is at the first position, both lateral edge portions of the movable member, and the free end edge portion of the movable member, are placed in contact with the corresponding walls of the second liquid passage. This arrangement is extremely useful when it is necessary to fill the first and second liquid passages each with a different liquid, since the downward movement of the movable member does not mix the liquid in the first liquid passage with the liquid in the second liquid passage, and the two liquids are prevented from diffusing each other when the liquid ejection head is not in action.

Further, it is also possible to prevent the movable member from entering the second liquid passage, by shaping the movable member so that its cross-section forms an inverted trapezoid, or by providing it with a projection.

Further, the movable member is prevented from sticking to the liquid passage wall, by placing plural projections on the bottom surface of the first liquid passage, in the area with which the movable member make contact.

Further, in the case of the twin liquid passage structure in which two liquid passages are filled with different liquids, the first liquid (liquid to be ejected) is prevented from mixing into the second liquid (bubble generation liquid); therefore, the liquid to be ejected is prevented from being scorched and sticking to the heater. Also, the movable member is prevented from sticking to the partition wall between the first and second liquid passages. Therefore, it is possible to provide a liquid ejection head, which is capable of stable ejection, and in which two liquid passages are given a different functions.

Other Embodiments

In the foregoing, the description has been made as to the major parts of the liquid ejecting head and the liquid ejecting method according to the embodiments of the present invention. the description will now be made as to further detailed embodiments usable with the foregoing embodiments. The following examples are usable with both of the single-flow-path type and two-flow-path type without specific statement.

Liquid Flow Path Ceiling Configuration

Figure 18:
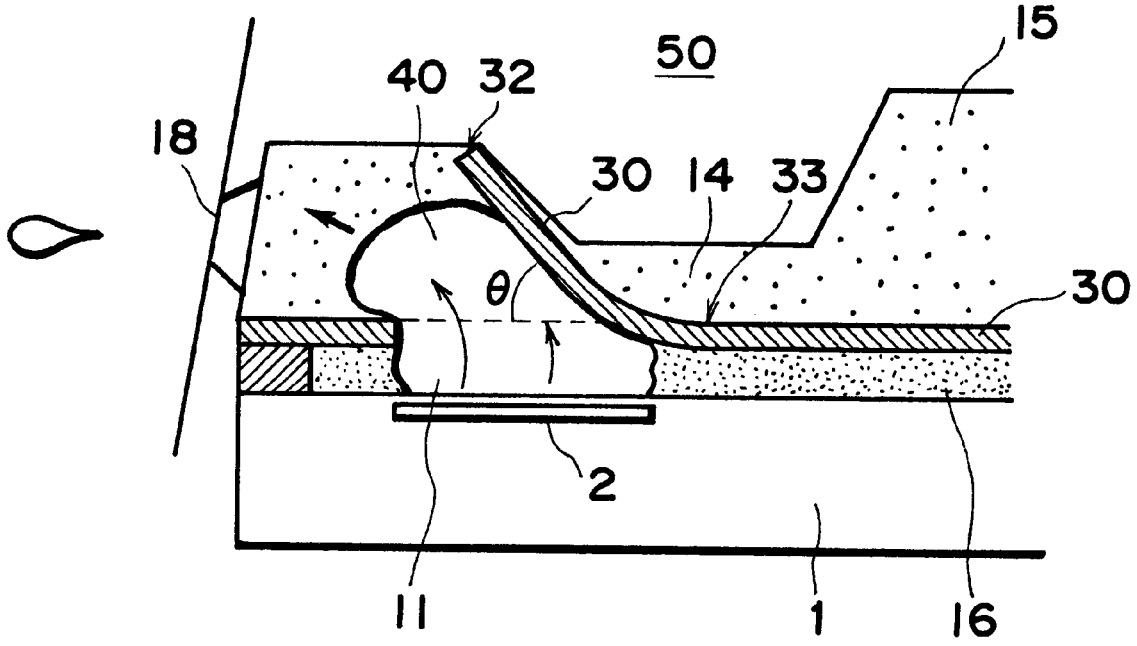
FIG. 18 depicts the moving member and the second liquid passage structure.

FIG. 18 is a sectional view taken along the length of the flow path of the liquid ejecting head according to the embodiment. grooves for constituting the first liquid flow paths 14 (or liquid flow paths 10 in FIG. 2) are formed in grooved member 50 on a partition wall 30. In this embodiment, the height of the flow path ceiling adjacent the free end 32 position of the movable member is greater to permit larger operation angle θ of the movable member. The operation range of the movable member is determined in consideration of the structure of the liquid flow path, the durability of the movable member and the bubble generation power or the like. It is desirable that it moves in the angle range wide enough to include the angle of the position of the ejection outlet.

As shown in this Figure, the displaced level of the free end of the movable member is made higher than the diameter of the ejection outlet, by which sufficient ejection pressure is transmitted. As shown in this Figure, a height of the liquid flow path ceiling at the fulcrum 33 position of the movable member is lower than that of the liquid flow path ceiling at the free end 32 position of the movable member, so that the release of the pressure wave to the upstream side due to the displacement of the movable member can be further effectively prevented.

Positional Relation Between Second Liquid Flow Path and Movable Member

Figure 19A:
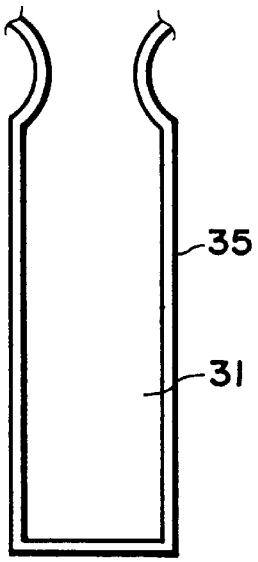
FIGS. 19(*a–c*) depict the moving member and the liquid passage structure.
Figure 19B:
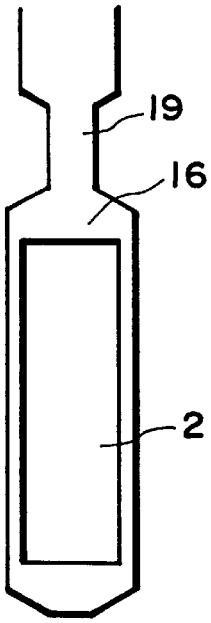
Figure 19C:
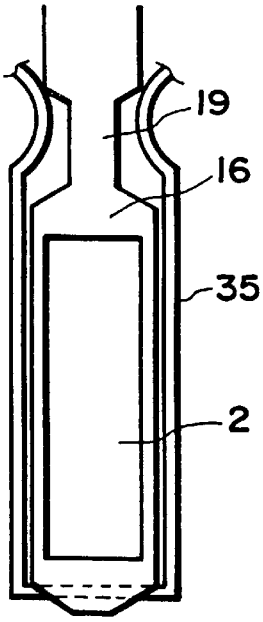

FIG. 19 is an illustration of a positional relation between the above-described movable member 31 and second liquid flow path 16, and (*a*) is a view of the movable member 31 position of the partition wall 30 as seen from the above, and (*b*) is a view of the second liquid flow path 16 seen from the above without partition wall 30. FIG. 19(*c*) is a schematic view of the positional relation between the movable member 6 and the second liquid flow path 16 wherein the elements are overlaid. In these Figures, the bottom is a front side having the ejection outlets.

The second liquid flow path 16 of this embodiment, as described hereinbefore, has a throat portion 19 upstream of the heat generating element 2 with respect to a general flow of the liquid from the second common liquid chamber side to the ejection outlet through the heat generating element position, the movable member position along the first flow path, so as to provide a chamber (bubble generation chamber) effective to suppress easy release, toward the upstream side, of the pressure produced upon the bubble generation in the second liquid flow path 16.

As shown in FIG. 19(*c*), the lateral sides of the movable member 31 cover respective parts of the walls constituting the second liquid flow path so that the falling of the movable member 31 into the second liquid flow path is prevented. By doing so, the above-described separation between the ejection liquid and the bubble generation liquid is further enhanced. Furthermore, the release of the bubble through the slit can be suppressed so that ejection pressure and ejection efficiency are further increased. Moreover, the above-described effect of the refilling from the upstream side by the pressure upon the collapse of bubble, can be further enhanced.

In FIG. 18, a part of of the bubble generated in the bubble generation region of the second liquid flow path 4 with the displacement of the movable member 6 to the first liquid flow path 14 side, extends into the first liquid flow path 14 side. by selecting the height of the second flow path to permit such extension of the bubble, the ejection force is further improved as compared with the case without such extension of the bubble. To provide such extending of the bubble into the first liquid flow path 14, the height of the second liquid flow path 16 is preferably lower than the height of the maximum bubble, more particularly, the second liquid flow path is preferably several $\mu$m–30 $\mu$, for example. In this embodiment, the height is 15 $\mu$m.

Movable Member and Partition Wall

Figure 20A:
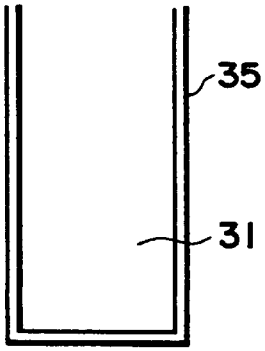
FIGS. 20(*a–c*) depict various configurations of the moving member.
Figure 20B:
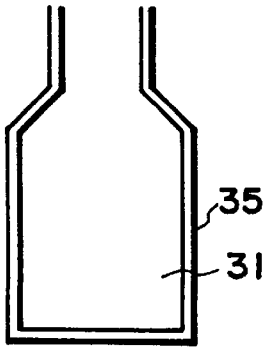
Figure 20C:
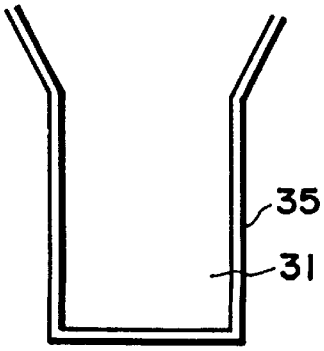

FIG. 20 shows another example of the movable member 31, wherein reference numeral 35 designates a slit formed in the partition wall, and the slit is effective to provide the movable member 31. In FIG. 16(*a*), the movable member has a rectangular configuration, and in (*b*), it is narrower in the fulcrum side to permit increased mobility of the movable member, and in (*c*), it has a wider fulcrum side to enhance the durability of the movable member. The configuration narrowed and arcuated at the fulcrum side is desirable if it does not enter the second liquid flow path side, and motion is easy with high durability.

In the foregoing embodiments, the plate or film movable member 31 and the separation wall 5 having this movable member was made of a nickel having a thickness of 5 $\mu$m, but this is not limited to this example, but it may be any if it has anti-solvent property against the bubble generation liquid and the ejection liquid, and if the elasticity is enough to permit the operation of the movable member, and if the required fine slit can be formed.

Preferable examples of the materials for the movable member include durable materials such as metal such as silver, nickel, gold, iron, titanium, aluminum, platinum, tantalum, stainless steel, phosphor bronze or the like, alloy thereof, or resin material having nytril group such as acrylonitrile, butadiene, stylene or the like, resin material having amide group such as polyamide or the like, resin material having carboxyl such as polycarbonate or the like, resin material having aldehyde group such as polyacetal or the like, resin material having sulfon group such as polysulfone, resin material such as liquid crystal polymer or the like, or chemical compound thereof; or materials having durability against the ink, such as metal such as gold, tungsten, tantalum, nickel, stainless steel, titanium, alloy thereof, materials coated with such metal, resin material having amide group such as polyamide, resin material having aldehyde group such as polyacetal, resin material having ketone group such as polyetheretherketone, resin material having imide group such as polyimide, resin material having hydroxyl group such as phenolic resin, resin material having ethyl group such as polyethylene, resin material having alkyl group such as polypropylene, resin material having epoxy group such as epoxy resin material, resin material having amino group such as melamine resin material, resin material having methylol group such as xylene resin material, chemical compound thereof, ceramic material such as silicon dioxide or chemical compound thereof.

Preferable examples of partition or division wall include resin material having high heat-resistive, high anti-solvent property and high molding property, more particularly recent engineering plastic resin materials such as polyethylene, polypropylene, polyamide, polyethylene terephthalate, melamine resin material, phenolic resin, epoxy resin material, polybutadiene, polyurethane, polyetheretherketone, polyether sulfone, polyallylate, polyimide, polysulfone, liquid crystal polymer (LCP), or chemical compound thereof, or metal such as silicon dioxide, silicon nitride, nickel, gold, stainless steel, alloy thereof, chemical compound thereof, or materials coated with titanium or gold.

The thickness of the separation wall is determined depending on the used, material and configuration from the standpoint of sufficient strength as the wall and sufficient operativity as the movable member, and generally, 0.5 $\mu$m–10 $\mu$m approx. is desirable.

The width of the slit 35 for providing the movable member 31 is 2 $\mu$m in the embodiments. when the bubble generation liquid and ejection liquid are different materials, and mixture of the liquids is to be avoided, the gap is determined so as to form a meniscus between the liquids, thus avoiding mixture therebetween. For example, when the bubble generation liquid has a viscosity about 2 cP, and the ejection liquid has a viscosity not less than 100 cP, 5 $\mu$m approx. slit is enough to avoid the liquid mixture, but not more than 3 $\mu$m is desirable.

When the ejection liquid and the bubble generation liquid are separated, the movable member functions as a partition therebetween. However, a small amount of the bubble generation liquid is mixed into the ejection liquid. In the case of liquid ejection for printing, the percentage of the mixing is practically of no problem, if the percentage is less than 20%. The percentage of the mixing can be controlled in the present invention by properly selecting the viscosities of the ejection liquid and the bubble generation liquid.

When the percentage is desired to be small, it can be reduced to 5%, for example, by using 5 CPS or lower fro the bubble generation liquid and 20 CPS or lower for the ejection liquid.

In this invention, the movable member has a thickness of $\mu$m order as preferable thickness, and a movable member having a thickness of $\mu$m order is not used in usual cases. When a slit is formed in the movable member having a thickness of $\mu$m order, and the slit has the width (W $\mu$m) of the order of the thickness of the movable member, it is desirable to consider the variations in the manufacturing.

When the thickness of the member opposed to the free end and/or lateral edge of the movable member formed by a slit, is equivalent to the thickness of the movable member (FIGS. 13, 14 or the like), the relation between the slit width and the thickness is preferably as follows in consideration of the variation in the manufacturing to stably suppress the liquid mixture between the bubble generation liquid and the ejection liquid. When the bubble generation liquid has a viscosity not more than 3 cp, and a high viscous ink (5 cp, 10 cp or the like) is used as the ejection liquid, the mixture of the 2 liquids can be suppressed for a long term if $W/t \leqq 1$ is satisfied.

The slit providing the "substantial sealing", preferably has several microns width, since the liquid mixture prevention is assured.

Element substrate

The description will be made as to a structure of the element substrate provided with the heat generating element for heating the liquid.

FIG. 21 is a longitudinal section of the liquid ejecting head according to an embodiment of the present invention.

On the element substrate 1, a grooved member 50 is mounted, the member 50 having second liquid flow paths 16, separation walls 30, first liquid flow paths 14 and grooves for constituting the first liquid flow path.

The element substrate 1 has, as shown in FIG. 12, patterned wiring electrode (0.2–1.0 $\mu$m thick) of aluminum or the like and patterned electric resistance layer 105 (0.01–0.2 $\mu$m thick) of hafnium boride ($HfB_2$), tantalum nitride(TaN), tantalum aluminum(TaAl) or the like constituting the heat generating element on a silicon oxide film or silicon nitride film 106 for insulation and heat accumulation, which in turn is on the substrate 107 of silicon or the like. A voltage is applied to the resistance layer 105 through the two wiring electrodes 104 to flow a current through the resistance layer to effect heat generation. Between the wiring electrode, a protection layer of silicon oxide, silicon nitride or the like of 0.1–2.0 $\mu$m thick is provided on the resistance layer, and in addition, an anti-cavitation layer of tantalum or the like (0.1–0.6 $\mu$m thick) is formed thereon to protect the resistance layer 105 from various liquid such as ink.

The pressure and shock wave generated upon the bubble generation and collapse is so strong that the durability of the oxide film which is relatively fragile is deteriorated. therefore, metal material such as tantalum (Ta) or the like is used as the anti-cavitation layer.

The protection layer may be omitted depending on the combination of liquid, liquid flow path structure and resistance material. one of such examples is shown in FIG. 19(*b*). The material of the resistance layer not requiring the protection layer, includes, for example, iridium—tantalum—aluminum alloy or the like. Thus, the structure of the heat generating element in the foregoing embodiments may include only the resistance layer(heat generation portion) or may include a protection layer for protecting the resistance layer.

In the embodiment, the heat generating element has a heat generation portion having the resistance layer which generates heat in response to the electric signal. this is not limiting, and it will suffice if a bubble enough to eject the ejection liquid is created in the bubble generation liquid. For example, heat generation portion may be in the form of a photothermal transducer which generates heat upon receiving light such as laser, or the one which generates heat upon receiving high frequency wave.

On the element substrate 1, function elements such as a transistor, a diode, a latch, a shift register and so on for selective driving the electrothermal transducer element may also be integrally built in, in addition to the resistance layer 105 constituting the heat generation portion and the electrothermal transducer constituted by the wiring electrode 104 for supplying the electric signal to the resistance layer.

Figure 22:
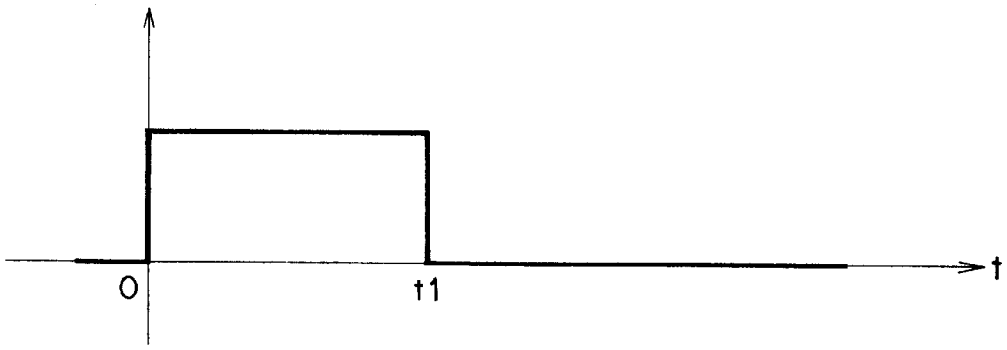
FIG. 22 is a diagram showing the form of the driving pulse.

In order to eject the liquid by driving the heat generation portion of the electrothermal transducer on the above-described element substrate 1, the resistance layer 105 is supplied through the wiring electrode 104 with rectangular pulses as shown in FIG. 22 to cause instantaneous heat generation in the resistance layer 105 between the wiring electrode. In the case of the heads of the foregoing embodiments, the applied energy has a voltage of 24V, a pulse width of 7 $\mu$sec, a current of 150 mA and a frequency of 6 kHz to drive the heat generating element, by which the liquid ink is ejected through the ejection outlet through the process described hereinbefore. However, the driving signal conditions are not limited to this, but may be any if the bubble generation liquid is properly capable of bubble generation.

Ejection Liquid and Bubble Generation Liquid

As described in the foregoing embodiment, according to the present invention, by the structure having the movable member described above, the liquid can be ejected at higher ejection force or ejection efficiency than the conventional liquid ejecting head. When the same liquid is used for the bubble generation liquid and the ejection liquid, it is possible that the liquid is not deteriorated, and that deposition on the heat generating element due to heating can be reduced. Therefore, a reversible state change is accomplished by repeating the gassification and condensation. So, various liquids are usable, if the liquid is the one not deteriorating the liquid flow passage, movable member or separation wall or the like.

Among such liquids, the one having the ingredient as used in conventional bubble jet device, can be used as a recording liquid.

When the two-flow-path structure of the present invention is used with different ejection liquid and bubble generation liquid, the bubble generation liquid having the above-described property is used, more particularly, the examples includes: methanol, ethanol, n-propyl alcohol, isopropyl alcohol, n- n-hexane, n-heptane, n-octane, toluene, xylene, methylene dichloride, trichloroethylene, Freon TF, Freon BF, ethyl ether, dioxane, cyclohexane, methyl acetate, ethyl acetate, acetone, methyl ethyl ketone, water, or the like, and a mixture thereof.

As for the ejection liquid, various liquids are usable without paying attention to the degree of bubble generation property or thermal property. The liquids which have not been conventionally usable, because of low bubble generation property and/or easiness of property change due to heat, are usable.

However, it is desired that the ejection liquid by itself or by reaction with the bubble generation liquid, does not impede the ejection, the bubble generation or the operation of the movable member or the like.

As for the recording ejection liquid, high viscous ink or the like is usable. As for another ejection liquid, pharmaceuticals and perfume or the like having a nature easily deteriorated by heat is usable. The ink of the following ingredient was used as the recording liquid usable for both of the ejection liquid and the bubble generation liquid, and the recording operation was carried out. Since the ejection speed of the ink is increased, the shot accuracy of the liquid droplets is improved, and therefore, highly desirable images were recorded. Dye ink viscosity of 2 cp

| | |
|---|---|
| (C.I. food black 2) dye | 3 wt. % |
| diethylene glycol | 10 wt. % |
| Thio diglycol | 5 wt. % |
| Ethanol | 5 wt. % |
| Water | 77 wt. % |

Recording operations were also carried out using the following combination of the liquids for the bubble generation liquid and the ejection liquid. As a result, the liquid having a ten and several cps viscosity, which was unable to be ejected heretofore, was properly ejected, and even 150 cps liquid was properly ejected to provide high quality image.

| | |
|---|---|
| Bubble generation liquid 1: | |
| Ethanol | 40 wt. % |
| Water | 60 wt. % |
| Bubble generation liquid 2: | |
| Water | 100 wt. % |
| Bubble generation liquid 3: | |
| Isopropyl alcoholic | 10 wt. % |
| Water | 90 wt. % |
| Ejection liquid 1: (Pigment ink approx. 15 cp) | |
| Carbon black | 5 wt. % |
| Stylene-acrylate-acrylate ethyl copolymer resin material | 1 wt. % |
| Dispersion material (oxide 140, weight average molecular weight) | |
| Mono-ethanol amine | 0.25 wt. % |
| Glyceline | 69 wt. % |
| Thiodiglycol | 5 wt. % |
| Ethanol | 3 wt. % |
| Water | 16.75 wt. % |
| Ejection liquid 2 (55 cp): | |
| Polyethylene glycol 200 | 100 wt. % |
| Ejection liquid 3 (l50 cp): | |
| Polyethylene glycol 600 | 100 wt. % |

In the case of the liquid which has not been easily ejected, the ejection speed is low, and therefore, the variation in the ejection direction is expanded on the recording paper with the result of poor shot accuracy. Additionally, variation of ejection amount occurs due to the ejection instability, thus preventing the recording of high quality image. However, according to the embodiments, the use of the bubble generation liquid permits sufficient and stabilized generation of the bubble. Thus, the improvement in the shot accuracy of the liquid droplet and the stabilization of the ink ejection amount can be accomplished, thus improving the recorded image quality remarkably.

Structure of Twin Liquid Passage Head

Figure 23:
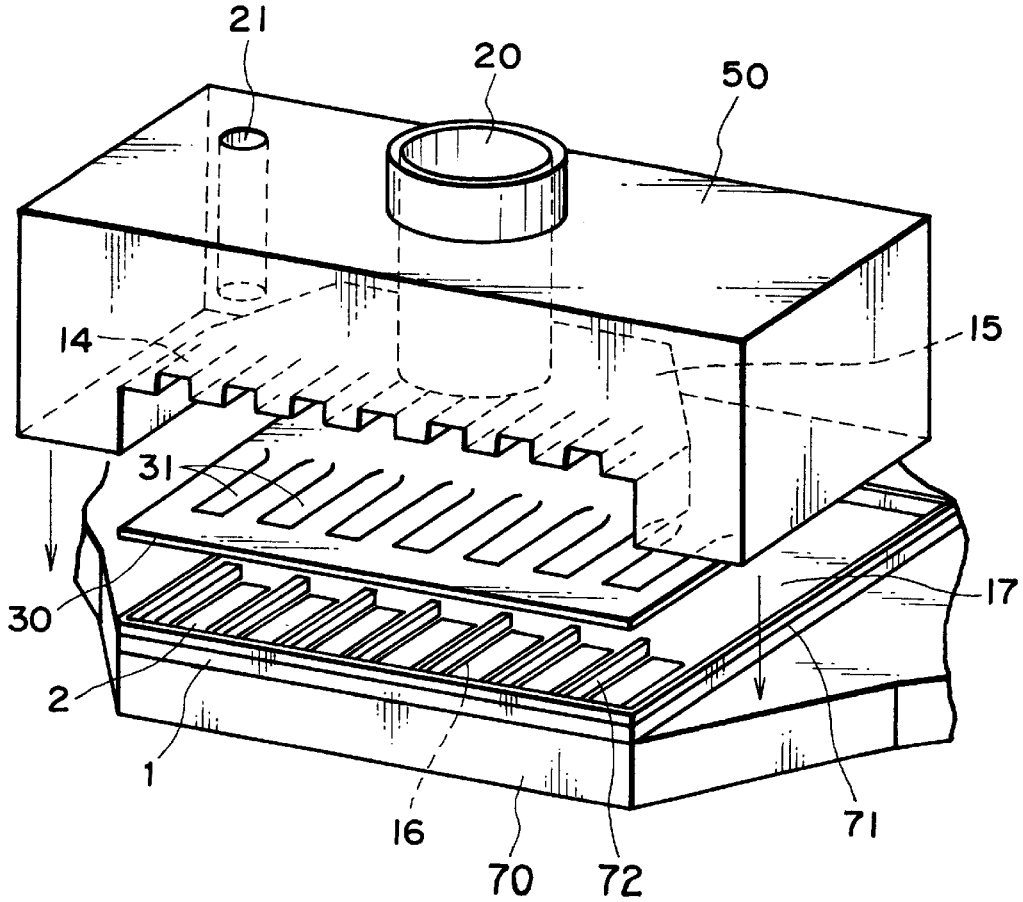
FIG. 23 is an exploded perspective view of the liquid ejection head in accordance with the present invention.

FIG. 23 is an exploded perspective view of the twin passage liquid ejection head in accordance with the present invention, and depicts its general structure.

The aforementioned element substrate 1 is disposed on a supporting member 70 of aluminum or the like. The wall 72 of the second liquid passage and the wall 71 of the second common liquid chamber 17 are disposed on this substrate 1. The partition wall 30, a part of which constitutes a moving member 31, is placed on top of them. On top of this partition wall 30, a grooved member 50 is disposed, which comprises: plural grooves constituting first liquid passages 14; a first common liquid chamber 15; a supply passage 20 for supplying the first common liquid chamber 15 with first liquid; and a supply passage 21 for supplying the second common liquid chamber 17 with second liquid.

Liquid Ejection Head Cartridge

The description will be made as to a liquid ejection head cartridge having a liquid ejecting head according to an embodiment of the present invention.

Figure 24:
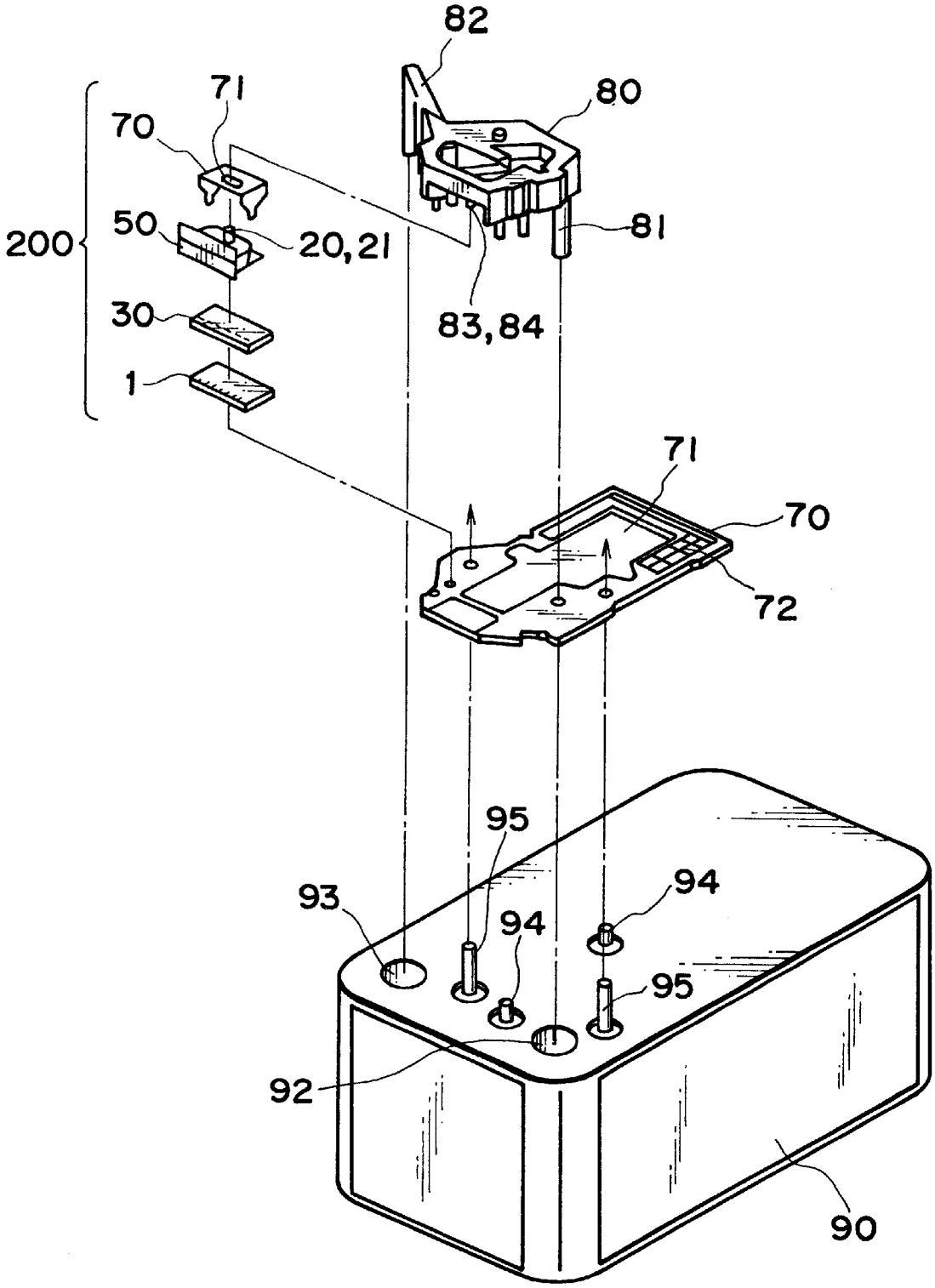
FIG. 24 is an exploded perspective view of a liquid ejection head cartridge.

FIG. 24 is a schematic exploded perspective view of a liquid ejection head cartridge including the above-described liquid ejecting head, and the liquid ejection head cartridge comprises generally a liquid ejecting head portion 200 and a liquid container 80.

The liquid ejecting head portion 200 comprises an element substrate 1, a separation wall 30, a grooved member 50, a confining spring 70, liquid supply member 90 and a supporting member 70. The element substrate 1 is provided with a plurality of heat generating resistors for supplying heat to the bubble generation liquid, as described hereinbefore. A bubble generation liquid passage is formed between the element substrate 1 and the separation wall 30 having the movable wall. By the coupling between the separation wall 30 and the grooved top plate 50, an ejection flow path (unshown) for fluid communication with the ejection liquid is formed.

The confining spring 70 functions to urge the grooved member 50 to the element substrate 1, and is effective to properly integrate the element substrate 1, separation wall 30, grooved and the supporting member 70 which will be described hereinafter.

Supporting member 70 functions to support an element substrate 1 or the like, and the supporting member 70 has thereon a circuit board 71, connected to the element substrate 1, for supplying the electric signal thereto, and contact pads 72 for electric signal transfer between the device side when the cartridge is mounted on the apparatus.

The liquid container 90 contains the ejection liquid such as ink to be supplied to the liquid ejecting head and the bubble generation liquid for bubble generation, separately. The outside of the liquid container 90 is provided with a positioning portion 94 for mounting a connecting member for connecting the liquid ejecting head with the liquid container and a fixed shaft 95 for fixing the connection portion. The ejection liquid is supplied to the ejection liquid supply passage 81 of a liquid supply member 80 through a supply passage 81 of the connecting member from the ejection liquid supply passage 92 of the liquid container, and is supplied to a first common liquid chamber through the ejection liquid supply passage 83, supply and 21 of the members. The bubble generation liquid is similarly supplied to the bubble generation liquid supply passage 82 of the liquid supply member 80 through the supply passage of the connecting member from the supply passage 93 of the liquid container, and is supplied to the second liquid chamber through the bubble generation liquid supply passage 84, 71, 22 of the members.

In such a liquid ejection head cartridge, even if the bubble generation liquid and the ejection liquid are different liquids, the liquids are supplied in good order. in the case that the ejection liquid and the bubble generation liquid are the same, the supply path for the bubble generation liquid and the ejection liquid are not necessarily separated.

After the liquid is used up, the liquid containers may be supplied with the respective liquids. To facilitate this supply, the liquid container is desirably provided with a liquid injection port. The liquid ejecting head and liquid container may be unseparably integral, or may be separable.

Liquid Ejecting Device

Figure 25:
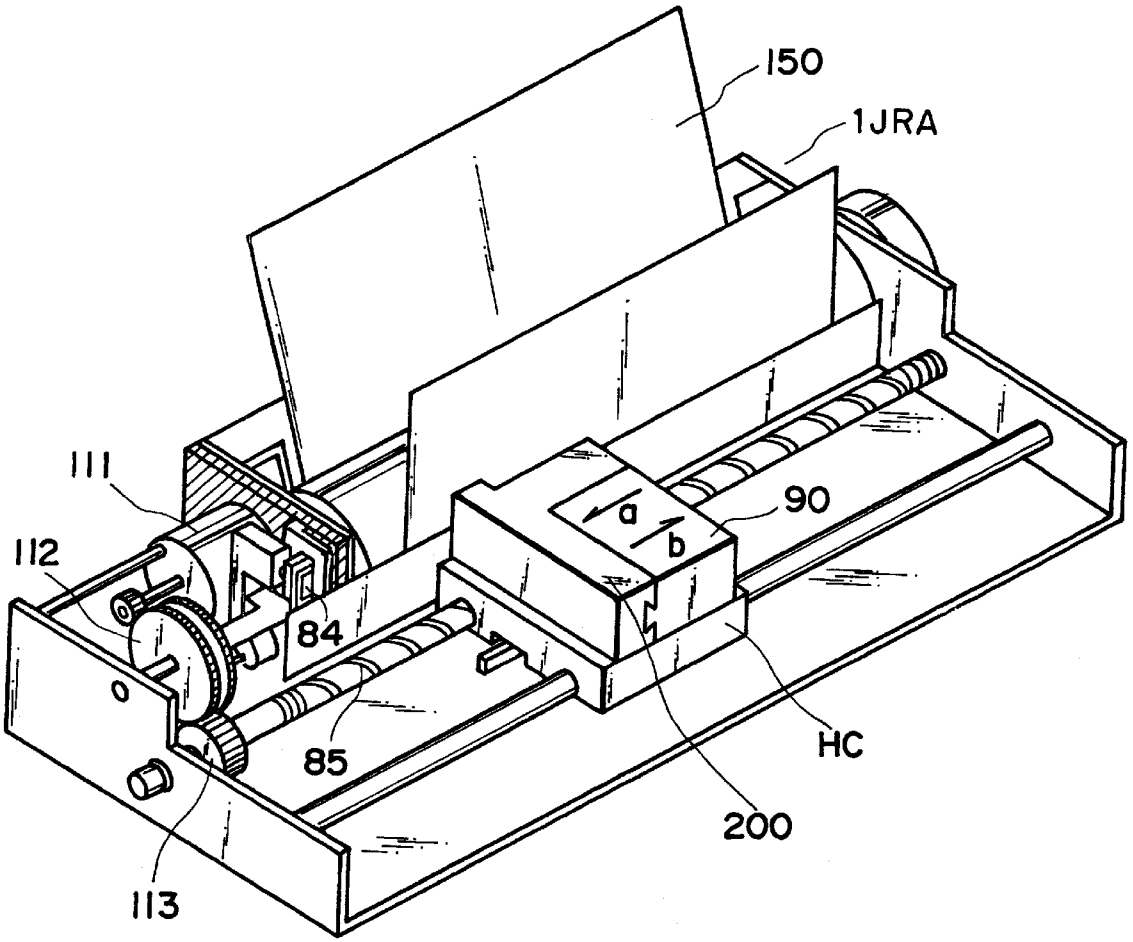
FIG. 25 is a perspective view of a liquid ejection apparatus, depicting the general structure thereof.

FIG. 25 is a schematic illustration of a liquid ejecting device used with the above-described liquid ejecting head. In this embodiment, the ejection liquid is ink, and the apparatus is an ink ejection recording apparatus. the liquid ejecting device comprises a carriage HC to which the head cartridge comprising a liquid container portion 90 and liquid ejecting head portion 200 which are detachably connectable with each other, is mountable. the carriage HC is reciprocable in a direction of width of the recording material 150 such as a recording sheet or the like fed by a recording material transporting means.

When a driving signal is supplied to the liquid ejecting means on the carriage from unshown driving signal supply means, the recording liquid is ejected to the recording material from the liquid ejecting head in response to the signal.

The liquid ejecting apparatus of this embodiment comprises a motor 111 as a driving source for driving the recording material transporting means and the carriage, gears 112, 113 for transmitting the power from the driving source to the carriage, and carriage shaft 115 and so on. By the recording device and the liquid ejecting method using this recording device, good prints can be provided by ejecting the liquid to the various recording material.

Figure 26:
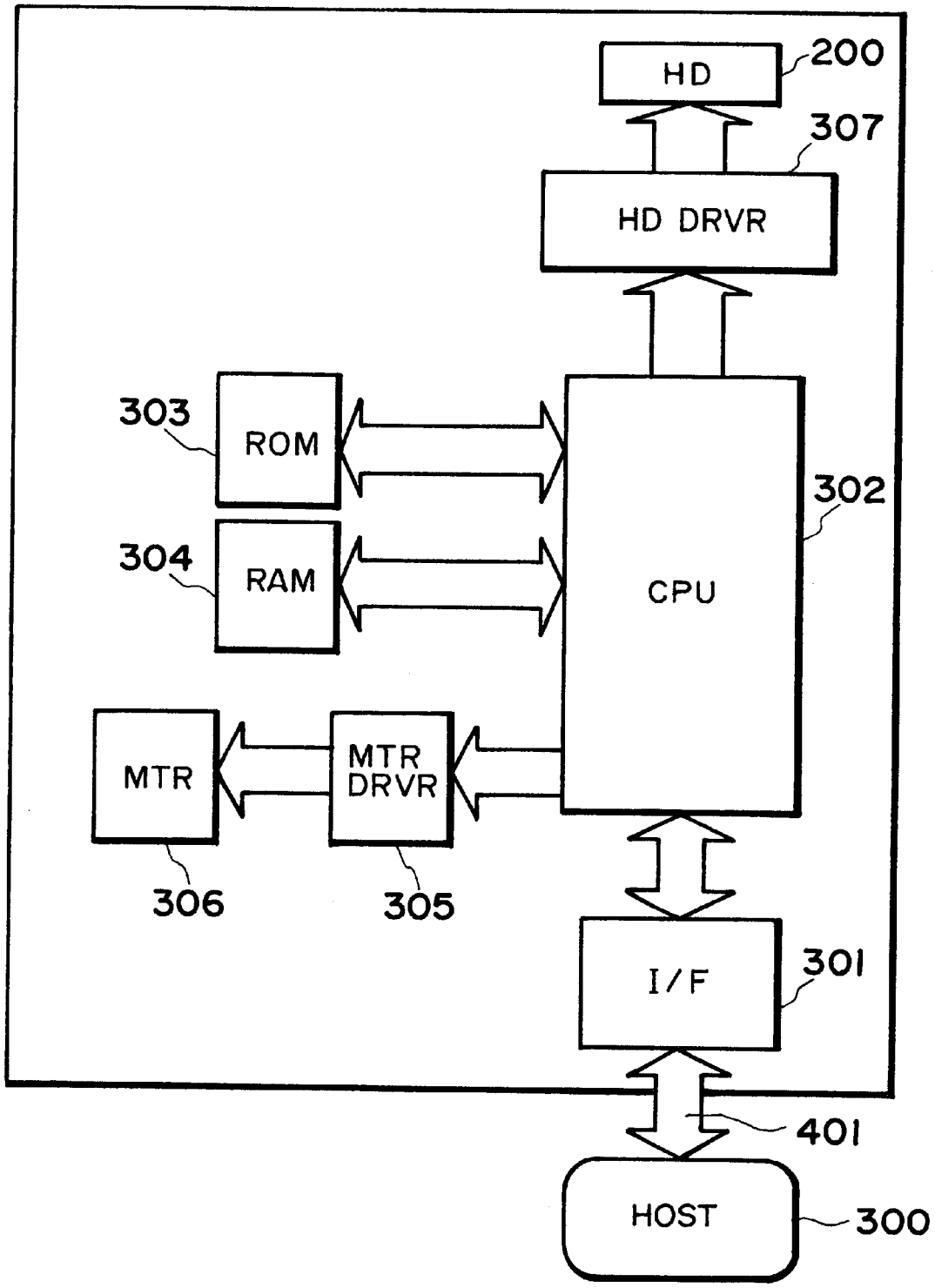
FIG. 26 is a block diagram of the apparatus illustrated in FIG. 25.

FIG. 26 is a block diagram for describing the general operation of an ink ejection recording apparatus which employs the liquid ejection method, and the liquid ejection head, in accordance with the present invention.

The recording apparatus receives printing data in the form of a control signal from a host computer 300. The printing data is temporarily stored in an input interface 301 of the printing apparatus, and at the same time, is converted into processable data to be inputted to a CPU 302, which doubles as means for supplying a head driving signal. The CPU 302 processes the aforementioned data inputted to the CPU 302, into printable data (image data), by processing them with the use of peripheral units such as RAMs 304 or the like, following control programs stored in an ROM 303.

Further, in order to record the image data onto an appropriate spot on a recording sheet, the CPU 302 generates driving data for driving a driving motor which moves the recording sheet and the recording head in synchronism with the image data. The image data and the motor driving data are transmitted to a head 200 and a driving motor 306 through a head driver 307 and a motor driver 305, respectively, which are controlled with the proper timings for forming an image.

As for recording medium, to which liquid such as ink is adhered, and which is usable with a recording apparatus-.such as the one described above, the following can be listed; various sheets of paper; OHP sheets; plastic material used for forming compact disks, ornamental plates, or the like; fabric; metallic material such as aluminum, copper, or the like; leather material such as cow hide, pig hide, synthetic leather, or the like; lumber material such as solid wood, plywood, and the like; bamboo material; ceramic material such as tile; and material such as sponge which has a three dimensional structure.

The aforementioned recording apparatus includes a printing apparatus for various sheets of paper or OHP sheet, a recording apparatus for plastic material such as plastic material used for forming a compact disk or the like, a recording apparatus for metallic plate or the like, a recording apparatus for leather material, a recording apparatus for lumber, a recording apparatus for ceramic material, a recording apparatus for three dimensional recording medium such as sponge or the like, a textile printing apparatus for recording images on fabric, and the like recording apparatuses.

As for the liquid to be used with these liquid ejection apparatuses, any liquid is usable as long as it is compatible with the employed recording medium, and the recording conditions.

Recording System

Next, an exemplary ink jet recording system will be described, which records images on recording medium, using, as the recording head, the liquid ejection head in accordance with the present invention.

Figure 27:
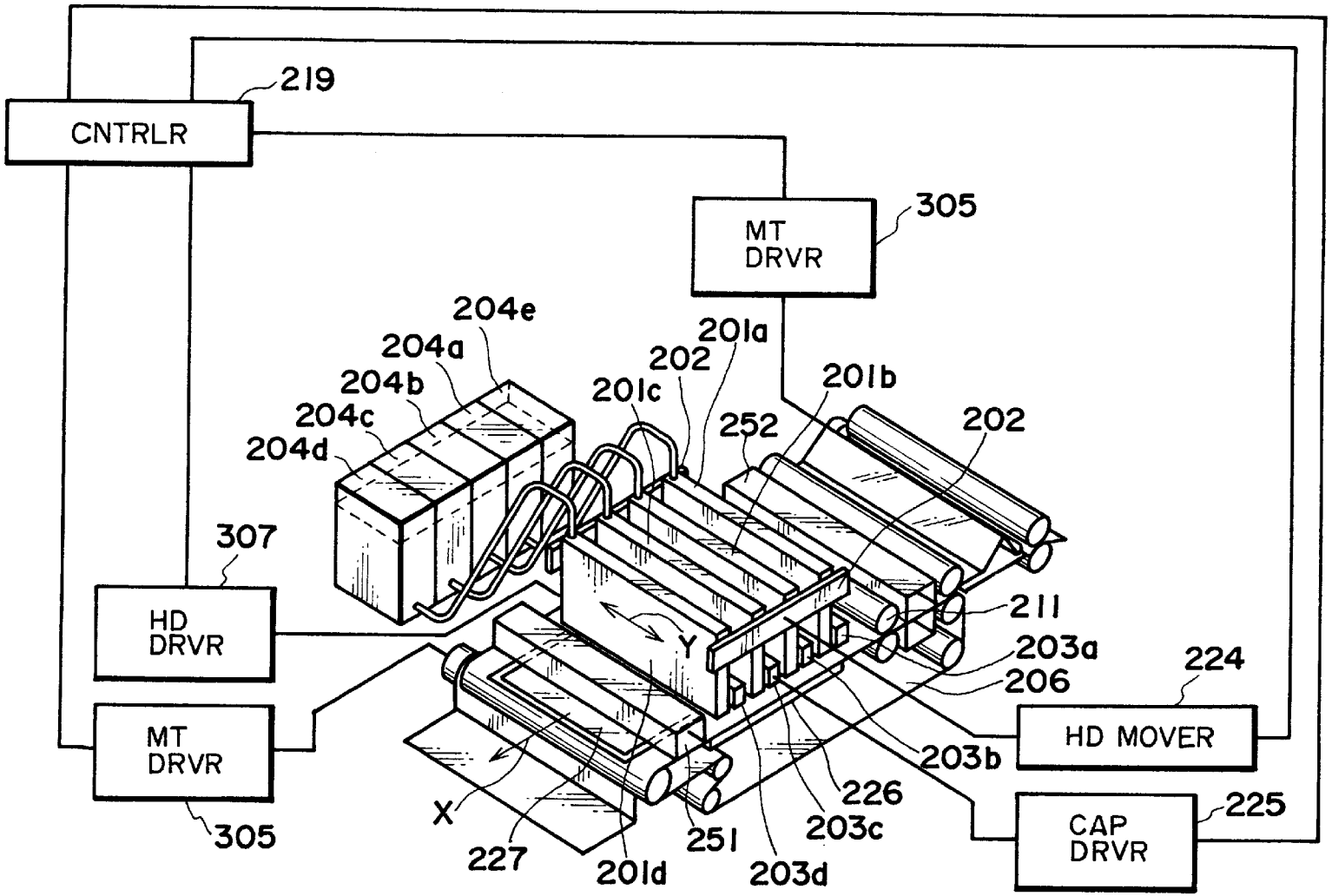
FIG. 27 is a perspective view of a liquid ejection recording system.

FIG. 27 is a schematic perspective view of an ink jet recording system employing the aforementioned liquid ejection head 201 in accordance with the present invention, and depicts its general structure. The liquid ejection head in this embodiment is a full-line type head, which comprises plural ejection orifices aligned with a density of 360 dpi so as to cover the entire recordable range of the recording medium 150. It comprises four heads, which are correspondent to four colors; yellow (Y), magenta (M), cyan (C) and black (Bk). These four heads are fixedly supported by a holder 1202, in parallel to each other and with predetermined intervals.

These heads are driven in response to the signals supplied from a head driver 307, which constitutes means for supplying a driving signal to each head.

Each of the four color inks (Y, M, C and Bk) is supplied to a correspondent head from an ink container 204*a*, 204*b*, 205*c* or 204*d*. A reference numeral 204*e* designates a bubble generation liquid container from which the bubble generation liquid is delivered to each head.

Below each head, a head cap 203*a*, 203*b*, 203*c* or 203*d* is disposed, which contains an ink absorbing member composed of sponge or the like. They cover the ejection orifices of the corresponding heads, protecting the heads, and also maintaining the head performance, during a non-recording period.

A reference numeral 206 designates a conveyer belt, which constitutes means for conveying the various recording medium such as those described in the preceding embodiments. The conveyer belt 206 is routed through a predetermined path by various rollers, and is driven by a driver roller connected to a motor driver 305.

The ink jet recording system in this embodiment comprises a pre-printing processing apparatus 251 and a post-printing processing apparatus 252, which are disposed on the upstream and downstream sides, respectively, of the ink jet recording apparatus, along the recording medium conveyance path. These processing apparatuses 251 and 252 process the recording medium in various manners before or after recording is made, respectively.

The pre-printing process and the postprinting process vary depending on the type of recording medium, or the type of ink. For example, when recording medium composed of metallic material, plastic material, ceramic material or the like is employed, the recording medium is exposed to ultra-violet rays and ozone before printing, activating its surface.

In a recording material tending to acquire electric charge, such as plastic resin material, the dust tends to deposit on the surface by static electricity. the dust may impede the desired recording. In such a case, the use is made with ionizer to remove the static charge of the recording material, thus removing the dust from the recording material. When a textile is a recording material, from the standpoint of feathering prevention and improvement of fixing or the like, a pre-processing may be effected wherein alkali property substance, water soluble property substance, composition polymeric, water soluble property metal salt, urea, or thiourea is applied to the textile. The pre-processing is not limited to this, and it may be the one to provide the recording material with the proper temperature.

On the other hand, the post-processing is a process for imparting, to the recording material having received the ink, a heat treatment, ultraviolet radiation projection to promote the fixing of the ink, or a cleaning for removing the process material used for the pre-treatment and remaining because of no reaction.

In this embodiment, the head is a full line head, but the present invention is of course applicable to a serial type wherein the head is moved along a width of the recording material.

Head Kit

Figure 28:
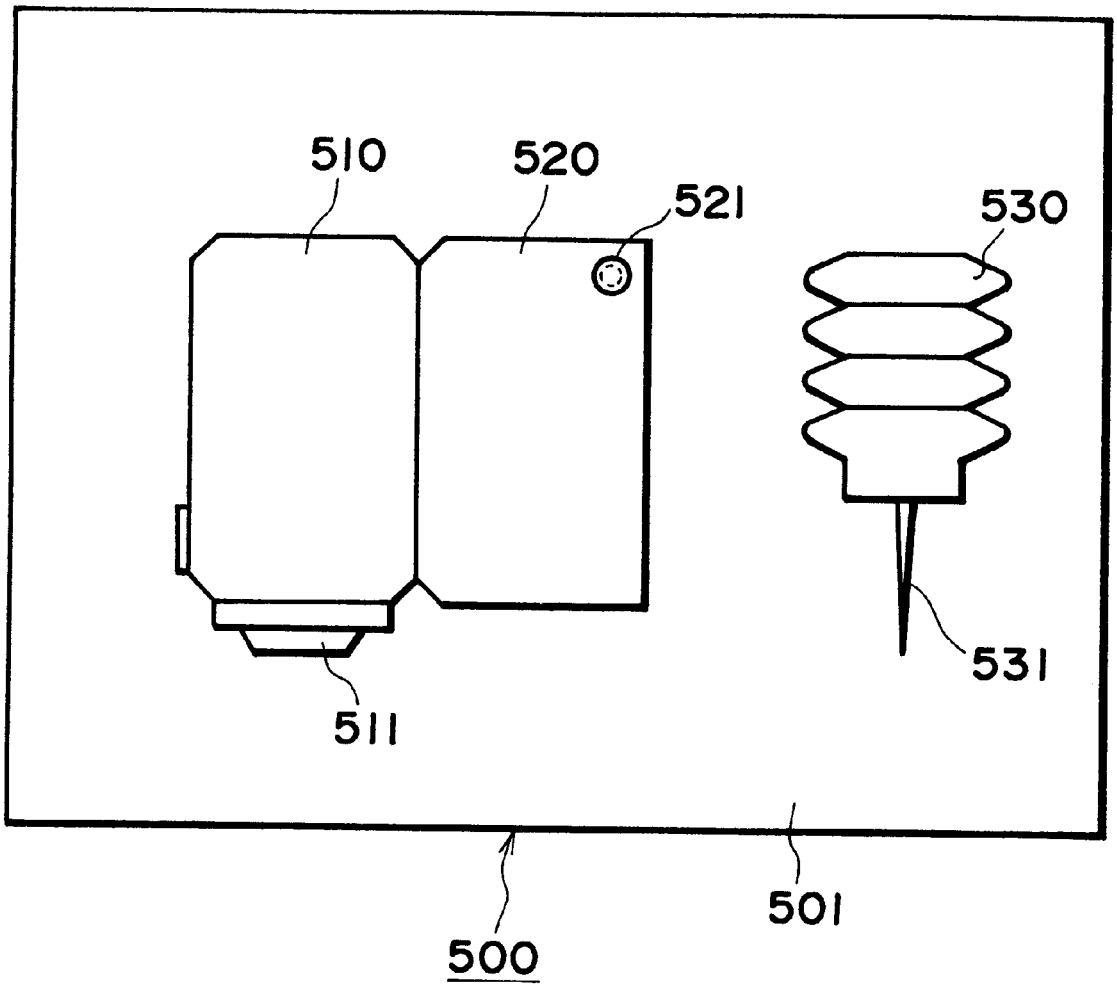
FIG. 28 is a schematic drawing of a head kit.

Hereinafter, a head kit will be described, which comprises the liquid ejection head in accordance with the present invention. FIG. 28 is a schematic view of such a head kit. This head kit is in the form of a head kit package 501, and contains: a head 510 in accordance with the present invention, which comprises an ink ejection section 511 for ejecting ink; an ink container 510, that is, a liquid container which is separable, or nonseparable, from the head; and ink filling means 530, which holds the ink to be filled into the ink container 520.

After the ink in the ink container 520 is completely depleted, the tip 530 (in the form of a hypodermic needle or the like) of the ink filling means is inserted into an air vent 521 of the ink container, the junction between the ink container and the head, or a hole drilled through the ink container wall, and the ink within the ink filling means is filled into the ink container through this tip 531.

When the liquid ejection head, the ink container, the ink filling means, and the like are available in the form of a kit contained in the kit package, the ink can be easily filled into the ink depleted ink container as described above; therefore, recording can be quickly restarted.

In this embodiment, the head kit contains the ink filling means. However, it is not mandatory for the head kit to contain the ink filling means; the kit may contain an exchangeable type ink container filled with the ink, and a head.

Even though FIG. 28 illustrates only the ink filling means for filling the printing ink into the ink container, the head kit may contain means for filling the bubble generation liquid into the bubble generation liquid container, in addition to the printing ink refilling means.

While the invention has been described with reference to the structures disclosed herein, it is not confined to the details set forth and this application is intended to cover such modifications or changes as may come within the purposes of the improvements or the scope of the following claims.

What is claimed is:

1. A liquid ejecting method for ejecting a liquid by generation of a bubble, comprising the steps of:

preparing a head comprising an ejection outlet to which the liquid is supplied directly from a liquid chamber for ejecting the liquid, a heat generating element for generating heat to form the bubble, the heat generating element having a heat generating surface which is at least one of substantially flush with and smoothly continuous with a surface upstream from said heat generating surface, a bubble generation region at which is generated the bubble in the liquid, a movable member having a fulcrum and a free end located downstream of the fulcrum relative to a direction of flow of the liquid;

generating a bubble by applying energy to the heat generating element;

displacing from a first position to a second position the free end of said movable member by a pressure produced by generation of the bubble in said bubble generating region; and restraining, with fluid communication maintained between the ejection outlet and the liquid chamber, the free end of said movable member from entering the bubble generation region beyond a first position which is taken by the free end of said movable member before generation of the bubble.

2. A method according to claim 1, wherein the bubble expands more in a downstream direction than in an upstream direction with respect to a direction of general flow of the liquid.

3. A method according to claim 1, wherein the bubble expands beyond the first position and moves the movable member to the second position.

4. A method according to claim 1, wherein the movement of the movable member allows the downstream portion of the bubble to grow downstream towards the movable member.

5. A method according to claim 1, wherein the movable member has a free end at a position downstream of the fulcrum, and the free end is moved by a deflection of the movable member with the fulcrum fixed.

6. A liquid ejecting method for ejecting a liquid droplet through an ejection outlet to which the liquid is supplied directly from a liquid chamber disposed at a position not faced to a bubble generation region having a heat generating element for generating heat to form a bubble, and downstream of the bubble generation region with respect to a liquid droplet ejection direction, by generating the bubble in the bubble generation region, the heat generating element having a heat generating surface which is at least one of substantially flush with and smoothly continuous with a surface upstream from said heat generating surface, comprising the steps of:

providing a movable member having a fulcrum and a free end portion located downstream of the fulcrum relative to a direction of flow of the liquid for substantially sealing, such that when said movable member is at a rest position, the ejection outlet and the bubble generating region are not directly communicated, an ejection outlet side region of said bubble generation region relative to said ejection outlet and a surface portion extending from the free end portion to a fulcrum portion which is disposed away from the free end in a direction away from said ejection outlet;

moving said free end from a substantial sealing position by generation of the bubble to open said bubble generation region to the ejection outlet to eject the liquid droplet; and restraining, with fluid communication maintained between the ejection outlet and the liquid chamber, the free end of said movable member from entering the bubble generation region beyond a first position which is taken by the free end of said movable member before generation of the bubble.

7. A method, according to claim 6, wherein said free end has a free end edge faced to an ejection outlet side.

8. A liquid ejection recording method wherein recording liquid is ejected from an ejection outlet to which the recording liquid is supplied directly from a liquid chamber by generation of a bubble to effect recording, comprising the steps of:

supplying the recording liquid along a heat generating element disposed along a flow path from upstream of the heat generating element, the heat generating element having a heat generating surface which is at least one of substantially flush with and smoothly continuous with a surface upstream from said heat generating element;

applying heat generated by the heat generating element to the recording liquid supplied to generate a bubble;

moving a free end about a fulcrum of a movable member, the free end being located downstream of the fulcrum relative to a direction of flow of the liquid, having the free end adjacent to an ejection outlet side by pressure produced by the generation of the bubble, to eject the liquid to the recording liquid, said movable member being disposed faced to said heat generating element; and restraining, with fluid communication maintained between the ejection outlet and the liquid chamber, the free end of said movable member from entering the bubble generation region beyond a first position which is taken by the free end of said movable member before generation of the bubble.

9. A method according to claim 8, wherein the bubble is generated by a film boiling caused by transferring heat generated by a heat generating element to the liquid.

10. A method according to claim 8, wherein the liquid is supplied to the heat generating element along an internal wall which is substantially flat or smoothly curved.

11. A method according to claim 8, wherein said heat generating element and said movable member are faced to each other with said bubble generating region therebetween, and said movable member is disposed such that a portion of the movable member corresponding to an area center of the heat generating element being displaceable.

12. A liquid ejecting method for ejecting liquid by generation of a bubble, comprising the steps of:

preparing a head including a first liquid flow path in fluid communication with a liquid ejection outlet to which the liquid is supplied directly from the liquid chamber, a heat generating element for generating heat to form the bubble, the heat generating element having a heat generating surface which is at least one of substantially flush with and smoothly continuous with a surface upstream from said heat generating surface, a second liquid flow path having a bubble generation region and a movable member disposed between said first liquid flow path and said bubble generation region and having a fulcrum and a free end located downstream of the fulcrum relative to a direction of flow of the liquid, adjacent the ejection outlet side; and generating a bubble in said bubble generation region;

displacing the free end of the movable member into said first liquid flow path in response to pressure produced by the generation of the bubble;

guiding the pressure toward the ejection outlet of said first liquid flow path by the movement of the movable member to eject the liquid; and restraining, with fluid communication maintained between the ejection outlet and the liquid chamber, the free end of said movable member from entering the bubble generation region beyond a first position which is taken by the free end of said movable member before generation of the bubble.

13. A method according to claim 1, 8 or 9, wherein the free end of said movable member is restrained by restraining means for engagement to the free end or portion of said movable member adjacent to the free end.

14. A method according to claim 13, wherein the free end is entirely engaged with the restraining means.

15. A method according to claim 14, wherein a flow resistance against movement of said movable member in its displacing direction by the generation of the bubble is smaller at the free end than upstream thereof.

16. A method according to claim 13, wherein the lateral end of said movable member which is closest to the election outlet is entirely engaged with the restraining means.

17. A method according to claim 1 or 12, wherein a heat generating element for generating the bubble is disposed faced to the movable member, and said bubble generation region is formed between the movable member and the heat generating element.

18. A method according to claim 17, wherein the bubble is generated by a film boiling caused by transferring heat generated by a heat generating element to the liquid.

19. A method according to claim 17, wherein the liquid is supplied to the heat generating element along an internal wall which is substantially flat or smoothly curved.

20. A method according to claim 12, wherein the bubble has a part, and the part of the bubble generated expands into the first liquid flow path with movement of the movable member.

21. A method according to claim 12, wherein the liquid supplied to the first liquid flow path is the same as the liquid supplied to the second liquid flow path.

22. A method, according to claim 5, 8 or 12, wherein said free end has a free end edge faced to an ejection outlet side.

23. A method according to claim 1, 6, 8 or 9, wherein the fulcrum is disposed upstream of an area center of said heat generating element, and the free end is disposed downstream of the area center.

24. A method according to claim 23, wherein an entire surface of said heat generating element and said movable member are faced to each other with said bubble generating region therebetween.

25. A liquid ejecting head for ejecting liquid by generation of bubble, comprising:

an ejection outlet to which the liquid is supplied directly from the liquid chamber for ejecting the liquid;

a heat generating element for generating heat to form the bubble, the heat generating element having a heat generating surface which is at least one of substantially flush with and smoothly continuous with a surface upstream from said heat generating surface;

a bubble generation region for generating the bubble in the liquid;

a movable member having a surface, a fulcrum and a free end located downstream of the fulcrum relative to a direction of flow of the liquid, said movable member being disposed to face said bubble generating region;

wherein the free end of said movable member moves from pressure produced by the generation of the bubble; and restraining means for restraining, with fluid communication maintained between the ejection outlet and the liquid chamber, the free end of said movable member from entering the bubble generation region beyond a first position which is taken by the free end of said movable member before generation of the bubble.

26. A head according to claim 25, wherein the bubble expands more toward downstream then toward upstream with respect to a direction of general flow of the liquid.

27. A head according to claim 25, wherein a heat generating element for generating the bubble is disposed faced to the movable member, and said bubble generation region is formed between the movable member and the heat generating element.

28. A head according to claim 27, wherein said liquid flow path has a supply passage for supplying the liquid to said heat generating element from upstream thereof along the heat generating element.

29. A head according to claim 28, wherein the liquid is supplied to the heat generating element along an internal wall which is substantially flat or smoothly curved.

30. A head according to claim 25, further comprising the liquid flow path for supplying the liquid to said heat generating element from upstream thereof along a surface of said movable member close to said heat generating element.

31. A head according to claim 27, wherein said liquid flow path has a supply passage for supplying the liquid to said heat generating element from upstream thereof along the heat generating element.

32. A head according to claim 27, wherein said liquid flow path has a supply passage for supplying the liquid to said heat generating element from upstream thereof along such a surface of said movable member as is nearer to said heat generating element.

33. A head according to claim 32, wherein said liquid flow path has an internal wall which is substantially flat or smoothly curved, and the supply passage is supplied to said heat generating element along the internal wall.

34. A liquid ejecting head for ejecting liquid by generation of bubble, comprising:

a first liquid flow path in fluid communication with an ejection outlet to which the liquid is supplied directly from the liquid chamber;

a second liquid flow path having a bubble generation region for generating the bubble in the liquid by applying heat to the liquid;

a heat generating element for generating heat to form the bubble, the heat generating element having a heat generating surface which is at least one of substantially flush with and smoothly continuous with a surface upstream from said heat generating surface;

a movable member disposed between said first liquid flow path and said bubble generation region and having a free end portion located downstream of the fulcrum relative to a direction of flow of the liquid adjacent the ejection outlet, a center of the heat generating element being displaceable, wherein the free end of the movable member is displaced into said first liquid flow path by pressure produced by the generation of the bubble, thus guiding the pressure toward the ejection outlet of said first liquid flow path by the movement of the movable member to eject the liquid; and restraining means for restraining, with fluid communication maintained between the ejection outlet and the liquid chamber, the free end of said movable member from entering the bubble generation region beyond a first position which is taken by the free end of said movable member before generation of the bubble.

35. A head according to claim 25 or 34, wherein the free end of said movable member is restrained by restraining means for engagement to the free end or a portion of said movable member adjacent to the free end.

36. A head according to claim 35, wherein the free end is entirely engaged with the restraining means.

37. A head according to claim 35, wherein the lateral end of said movable member which is closest to the ejection outlet is entirely engaged with the restraining means.

38. A head according to claim 25 or 34, wherein the free end is restrained from entering the bubble generation region said resstrining means limiting movement of a fre end portion including the free end.

39. A head according to claim 25 or 34, wherein said restraining means is in the form of a wall defining said second liquid path and effects its restraining action by contact of a part of said movable member to the wall.

40. A head according to claim 39, wherein said wall constitutes a side wall of a second liquid flow path.

41. A head according to claim 39, wherein said wall constitutes a top wall of a second liquid flow path.

42. A head according to claim 34, wherein a heat generating element for generating the bubble is disposed faced to the movable member, and said bubble generation region is formed between the movable member and the heat generating element.

43. A head according to claim 42, wherein the liquid is supplied to the heat generating element along an internal wall which is substantially flat or smoothly curved.

44. A head according to claim 25, 31, 32 or 42, wherein said movable member is in a form of a plate.

45. A head according to claim 44, wherein all of the surface of said heat generating element is faced to said movable member.

46. A head according to claim 44, wherein a total area of said movable member is larger than a total area of said heat generating element.

47. A head according to claim 44, wherein a fulcrum of said movable member is at a position out of a portion right above said heat generating element.

48. A head according to claim 44, wherein the free end of said movable member has a portion extending in a direction substantially perpendicular to the liquid flow path having said heat generating element.

49. A head according to claim 44, wherein said free end of said movable member is disposed at a position nearer to said ejection outlet than said heat generating element.

50. A head according to claim 25, 31, 32, or 42, wherein said heat generating element includes an electrothermal transducer having a heat generating resistor for generating heat upon electric energization.

51. A head according to claim 42, wherein a distance between a surface of said heat generating element and said movable member, is not more than 30 $\mu$m.

52. A head according to claim 25 or 42, wherein the fulcrum is disposed upstream of an area center of said heat generating element, and the free end is disposed downstream of the area center.

53. A head according to claim 34, wherein the liquid supplied to the first liquid flow path is the same as the liquid supplied to the second liquid flow path.

54. A head according to claim 34, the liquid ejected through said ejection outlet is ink.

55. A head according to claim 25, 31, 32, 34, or 42 or 49, wherein said free end has a free end edge faced to an ejection outlet side.

56. A head according to claim 25 or 34, wherein said heat generating element and said movable member are faced to each other with said bubble generating region therebetween, and said movable member is disposed such that a portion of the movable member corresponding to an area center of the heat generating element being displaceable.

57. A liquid ejection recording method for ejecting recording liquid by generation of a bubble to effect recording, comprising the steps of:

preparing a head comprising an ejection outlet to which the liquid is supplied directly from the liquid chamber for ejecting the recording liquid, a heat generating element for generating heat to form the bubble, the heat generating element having a heat generating surface which is at least one of substantially flush with and smoothly continuous with a surface upstream from said heat generating surface, a bubble generation region for generating the bubble in the liquid, a movable member having a fulcrum and a free end located downstream of the fulcrum relative to a direction of flow of the liquid, said movable member being disposed faced to said bubble generating region;

generating a bubble by applying energy to the heat generating element;

displacing the free end of said movable member by pressure produced by the generation of the bubble in said bubble generating portion; and restraining, with fluid communication maintained between the ejection outlet and the liquid chamber, the free end of said movable member from entering the bubble generation region beyond a first position which is taken by the free end of said movable member before generation of the bubble.

58. A method according to claim 1, 6, or 57, wherein said heat generating element and said movable member are faced to each other with said bubble generating region therebetween, and said movable member is disposed such that a portion of the movable member corresponding to an area center of the heat generating element being displaceable.

* * * * *

UNITED STATES PATENT AND TRADEMARK OFFICE

CERTIFICATE OF CORRECTION

PATENT NO. : 6,312,111 B1
DATED : November 6, 2001
INVENTOR(S) : Makiko Kimura et al.

It is certified that error appears in the above-identified patent and that said Letters Patent is hereby corrected as shown below:

Column 2,
Line 19, “th” should read -- the --; and
Line 30, “if” should read -- If --.

Column 3,
Line 1, “procide” should read -- provide --;
Line 25, “regurated” should read -- regulated --; and
Line 59, “it” should read -- its --.

Column 4,
Line 39, “from by” should read -- from --.

Column 6,
Line 34, “FIG. 2” should read -- FIGS. 2 --.

Figure 21A:
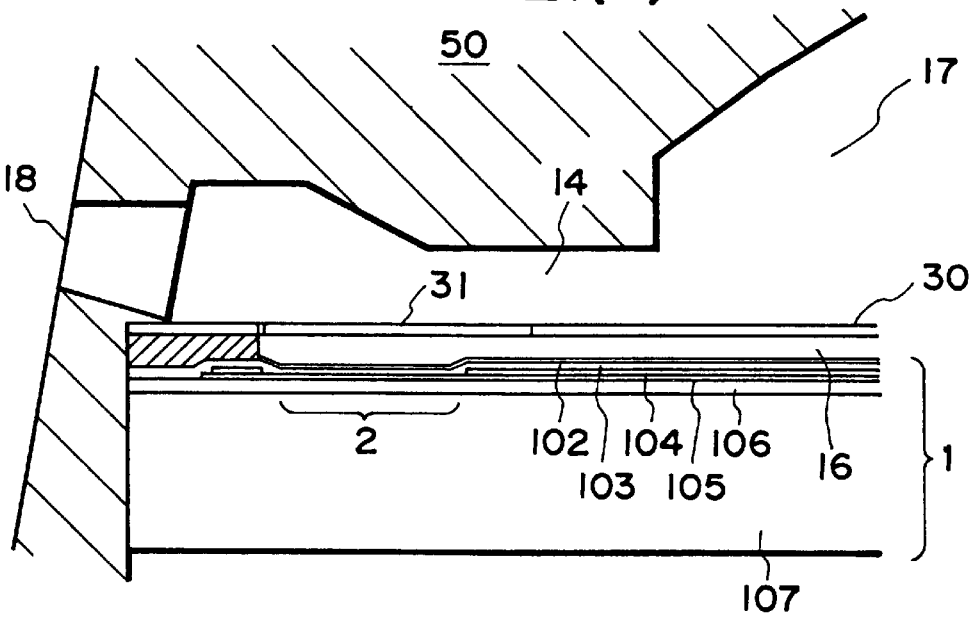
FIG. 21 is a longitudinal section of the liquid ejection head in accordance with the present invention.
Figure 21B:
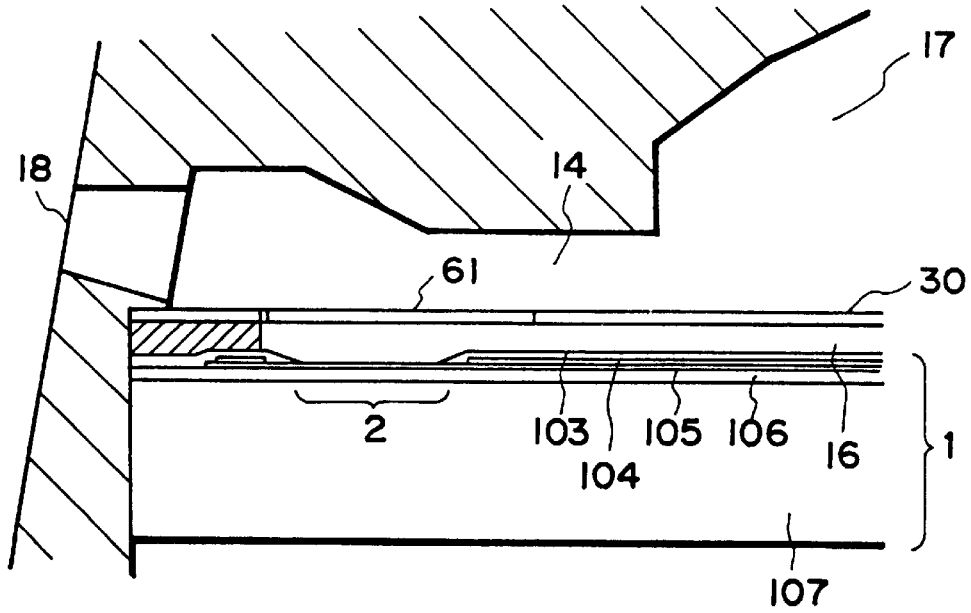

Column 7,
Line 17, “FIG. 21 is” should read -- FIGS. 21(a) and 21(b) depict --.

Column 8,
Line 62, “of the is” should read -- is --.

Column 9,
Line 1, “this” should read -- This --; and “contributable” should read -- contributes --;
Line 11, “thus,” should read -- Thus, --; and
Line 58, “by” should read -- By --.

Column 10,
Line 6, “10” should be deleted.

Column 11,
Line 18, “however,” should read -- However, --.

Column 13,
Line 36, “movable” should read -- moving --.

Column 14,
Line 16, “anyone” should read -- otherwise --.

Column 17,
Line 62, “liquid a” should read -- liquid is a --; and
Line 63, “by” should read -- By --.

UNITED STATES PATENT AND TRADEMARK OFFICE

CERTIFICATE OF CORRECTION

PATENT NO. : 6,312,111 B1
DATED : November 6, 2001
INVENTOR(S) : Makiko Kimura et al.

It is certified that error appears in the above-identified patent and that said Letters Patent is hereby corrected as shown below:

Column 18,
Line 4, “high” should read -- highly --; and
Line 12, “by” should read -- By --.

Column 21,
Line 6, “make” should read -- makes --.

Column 22,
Line 27, “by” should read -- By --;
Line 34, “μ,” should read -- μm, --; and
Line 62, “nytril” should read -- nitrile --.

Column 23,
Line 38, “when” should read -- When --;
Line 57, “fro” should read -- for --; and
Line 63, “μm” should read -- cm --.

Column 24,
Line 56, “layer(heat” should read -- layer (heat) --; and
Line 61, “this” should read -- This --.

Column 25,
Line 65, “is” should read -- are --.

Column 28,
Line 58, “apparatus-” should read -- apparatus --; and
Line 59, “.such” should read -- such --.

Column 34,
Line 8, “then” should read -- than --.

Column 35,
Line 14, “resstrining” should read -- restraining --; and “fre” should read -- free --.

UNITED STATES PATENT AND TRADEMARK OFFICE

CERTIFICATE OF CORRECTION

PATENT NO. : 6,312,111 B1
DATED : November 6, 2001
INVENTOR(S) : Makiko Kimura et al.

It is certified that error appears in the above-identified patent and that said Letters Patent is hereby corrected as shown below:

Column 36,
Line 8, "34, the" should read -- 34, wherein the --; and
Line 10, "42 or 49," should read -- 42, --.

Signed and Sealed this

Thirtieth Day of July, 2002

*Attest:*

*Attesting Officer*

JAMES E. ROGAN
*Director of the United States Patent and Trademark Office*